US012723333B2

(12) United States Patent
Hawkinson et al.

(10) Patent No.: US 12,723,333 B2
(45) Date of Patent: Sep. 1, 2026

(54) TEXTILE CONFIGURED TO PROMOTE COOLING

(71) Applicant: NIKE, Inc., Beaverton, OR (US)

(72) Inventors: Karen A. Hawkinson, Portland, OR (US); Daniel P. Morgan, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 19/263,269

(22) Filed: Jul. 8, 2025

(65) Prior Publication Data

US 2026/0013583 A1 Jan. 15, 2026

Related U.S. Application Data

(60) Provisional application No. 63/779,028, filed on Mar. 27, 2025, provisional application No. 63/735,118, (Continued)

(51) Int. Cl.

| | |
|---|---|
| ***D04B 1/10*** | (2006.01) |
| ***A41D 31/14*** | (2019.01) |
| ***D04B 1/24*** | (2006.01) |

(52) U.S. Cl.

CPC ..... *D04B 1/104* (2013.01); *A41D 31/14* (2019.02); *D04B 1/24* (2013.01)

(58) Field of Classification Search

CPC ..... D04B 21/10; D04B 23/08; D04B 9/12; D04B 7/12; D04B 1/12; D04B 1/104; D04B 21/12; A41D 31/14; A41D 31/145

See application file for complete search history.

(56) References Cited

U.S. PATENT DOCUMENTS 5,385,036 A * 1/1995 Spillane ..... A43B 1/04 66/196
5,601,907 A * 2/1997 Matsumoto ..... D04B 21/10 428/134

(Continued)

FOREIGN PATENT DOCUMENTS

JP 2003-055804 A 2/2003
JP 2020-196980 A 12/2020

(Continued)

OTHER PUBLICATIONS

International Search Report and Written Opinion received for PCT Patent Application No. PCT/US2025/037006, mailed on Nov. 5, 2025, 15 pages.

(Continued)

*Primary Examiner* — Danny Worrell
(74) *Attorney, Agent, or Firm* — Shook, Hardy & Bacon L.L.P.

(57) ABSTRACT

Aspects herein are directed to textile that includes a first layer formed from a first plurality of yarns or fibers. The first layer includes a first set of apertures, each aperture having a first opening size. The textile further includes a second layer formed from a second plurality of yarns or fibers. The second layer includes a second set of apertures. Each aperture in the second set of apertures is axially aligned with a corresponding aperture in the first set of apertures. Each aperture in the second set of apertures has a second opening size that is smaller than the first opening size of apertures in the first set of apertures. The first layer is relatively more hydrophilic than the second layer.

30 Claims, 15 Drawing Sheets

Related U.S. Application Data filed on Dec. 17, 2024, provisional application No. 63/720,522, filed on Nov. 14, 2024, provisional application No. 63/669,619, filed on Jul. 10, 2024.

(56) References Cited

U.S. PATENT DOCUMENTS

| | | | | |
|---|---|---|---|---|
| 6,305,875 | B1 * | 10/2001 | Matsumoto | D04B 21/20 405/32 |
| 6,399,523 | B1 * | 6/2002 | Matsumoto | A01G 20/00 66/196 |
| 6,477,865 | B1 * | 11/2002 | Matsumoto | D04B 21/10 66/196 |
| 6,630,414 | B1 | 10/2003 | Matsumoto | |
| 7,235,504 | B2 * | 6/2007 | Shirasaki | A47C 31/006 66/196 |
| 7,565,821 | B2 * | 7/2009 | Park | B60N 2/976 66/195 |
| 10,597,805 | B2 * | 3/2020 | Takahashi | D04B 21/10 |
| 11,105,025 | B2 * | 8/2021 | Boylu | D04B 21/16 |
| 11,828,008 | B2 | 11/2023 | Jiang et al. | |
| 11,993,067 | B2 | 5/2024 | Mueller et al. | |
| 12,473,671 | B2 * | 11/2025 | Kawabata | D04B 1/22 |
| 2002/0104335 | A1 * | 8/2002 | Shirasaki | D04B 21/02 66/196 |
| 2002/0157429 | A1 * | 10/2002 | Matsumoto | D04B 21/10 66/195 |
| 2012/0260422 | A1 * | 10/2012 | Rock | B32B 5/024 5/486 |
| 2013/0152640 | A1 | 6/2013 | Kunde et al. | |
| 2015/0104604 | A1 * | 4/2015 | Rock | B32B 5/26 5/413 R |
| 2019/0368087 | A1 * | 12/2019 | Boylu | D04B 1/24 |
| 2022/0282409 | A1 * | 9/2022 | Hendry | D04B 1/126 |
| 2022/0339904 | A1 * | 10/2022 | Amin | D04B 1/246 |
| 2025/0137176 | A1 * | 5/2025 | Kawabata | D04B 1/22 |

FOREIGN PATENT DOCUMENTS

| | | | |
|---|---|---|---|
| KR | 10-2018-0077104 | A | 7/2018 |
| WO | 2024/232983 | A1 | 11/2024 |

OTHER PUBLICATIONS

Invitation to Pay Additional Fees received for PCT Patent Application No. PCT/US2025/037011, mailed on Nov. 7, 2025, 15 pages.

Sun et al., "Novel Ventilation Design of Combining Spacer and Mesh Structure in Sports T-shirt Significantly Improves Thermal Comfort", Applied Ergonomics, vol. 48, May 2015, pp. 138-147.

International Search Report and Written Opinion received for PCT Patent Application No. PCT/US2025/037009, mailed on Nov. 18, 2025, 15 pages.

International Search Report and Written Opinion received for PCT Patent Application No. PCT/US2025/037011, mailed on Jan. 26, 2026, 26 pages.

* cited by examiner

TEXTILE CONFIGURED TO PROMOTE COOLING

CROSS-REFERENCE TO RELATED APPLICATIONS

This application claims the benefit of and priority to U.S. Provisional Patent Application No. 63/669,619, filed on Jul. 10, 2024; U.S. Provisional Patent Application No. 63/720,522, filed on Nov. 14, 2024; U.S. Provisional Patent Application No. 63/735,118, filed on Dec. 17, 2024; and U.S. Provisional Patent Application No. 63/779,028, filed on Mar. 27, 2025, each of which is hereby incorporated by reference in its entirety.

BACKGROUND

Typical athletic garments may be formed of textiles that are fast-drying and/or promote air flow through the garment and help cool the wearer. However, conventional features of typical textiles used for athletic garments may not provide adequate cooling, e.g. in certain environmental conditions.

BRIEF DESCRIPTION OF THE DRAWINGS

Examples of aspects herein are described below in detail with reference to the attached drawing figures, wherein.

DETAILED DESCRIPTION

Figure 1A:
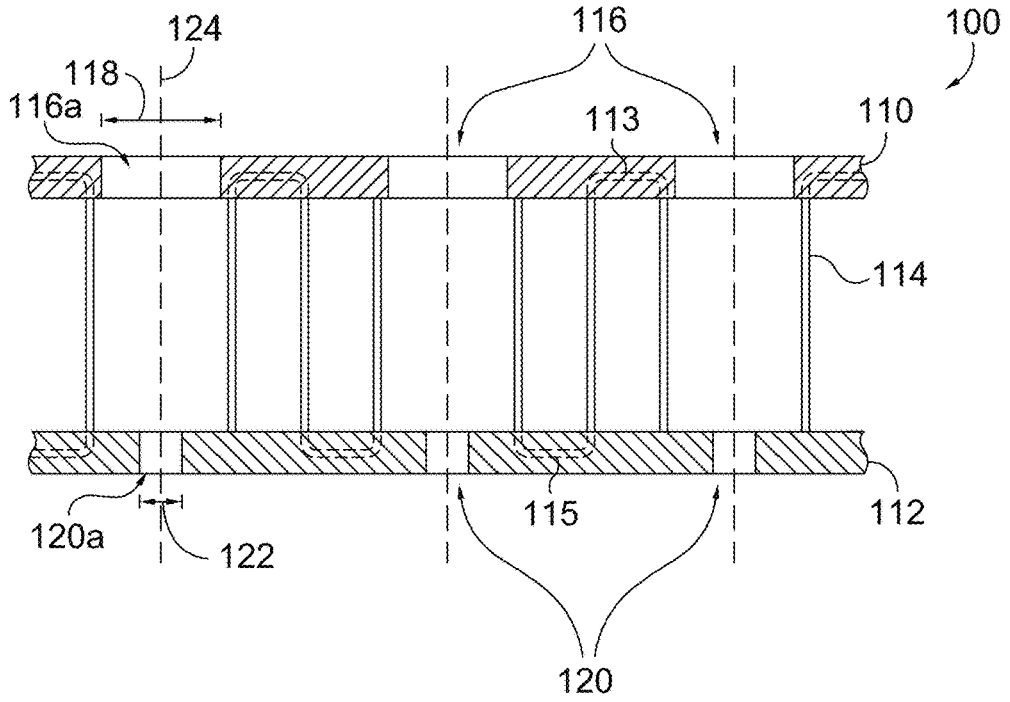
FIG. 1A illustrates a schematic cross-section view of an example knit spacer textile in accordance with aspects herein.

Aspects herein are directed to a textile, a garment formed from the textile, and methods of manufacturing the textile, where the textile includes features that help improve cooling when worn by a wearer in various environments.

Conventional textiles, particularly those used in performance garments, often suffer from inadequate air circulation and cooling, especially when exposed to moisture such as sweat, rain, or other liquids. When wet, the fibers in these textiles can swell, and water (or other liquid) can obstruct small openings formed by the knit loops, significantly reducing breathability. In addition, the fabric may cling to the skin due to a lack of structural stiffness or too much drape, further impeding airflow and causing discomfort.

To address the deficiencies of conventional textiles, aspects disclosed herein provide a textile, such as a knit spacer textile, that includes apertures continuously extending from a front surface to a second surface. These apertures may be integrally formed during the knitting process and are orders of magnitude larger than the small interstitial spaces typically formed between loops in conventional knit structures. As a result, even when the yarns swell due to moisture absorption or when moisture is retained on the surface of the textile, air may still flow freely through the larger, uninterrupted apertures. Additionally, the textile may be engineered to possess a controlled stiffness and drape, which reduces cling to the wearer's skin and thereby enhances airflow and overall breathability.

As used herein, the term "aperture" is distinct from the small interstitial spaces or gaps that naturally occur between yarns at the loop intersections of conventional knit structures (i.e., between adjacent courses and wales). While such interstitial spaces may permit limited airflow, especially when dry, they are typically small and prone to obstruction when the textile becomes wet or the yarns swell. In contrast, the apertures described herein are discrete, intentionally formed structures that extend continuously from one surface of the textile to the other. These apertures are substantially larger in size and are not merely incidental to the knit loop geometry; rather, they are purposefully incorporated into the textile to maintain airflow and breathability even under wet conditions.

This structural configuration supports multiple forms of cooling depending on environmental conditions. For example, when the ambient environment is cooler than the wearer, the continuous apertures may promote convective cooling by allowing ambient air to flow more freely to the skin. Conversely, when the environment is warmer than the wearer, airflow through the apertures may still contribute to evaporative cooling, as moisture retained on or within the textile evaporates and lowers the local temperature of the passing air. In all cases, the enhanced airflow enabled by the larger apertures, combined with the anti-cling characteristics imparted by the textile's stiffness, may lead to improved evaporative cooling and thermal comfort for the wearer.

In certain use cases, such as when the textile disclosed herein is worn by a person engaged in active movement (e.g., running), the combination of the textile's structural stiffness and its integrally formed, continuously extending apertures may facilitate a pumping effect. Movement of the garment relative to the body may cyclically compress and release localized areas of the textile, thereby promoting air exchange between the interior and exterior environments. This dynamic airflow may further enhance convective and evaporative cooling by drawing in fresh air and expelling warm, humid air from within the garment.

Exemplarily, the textile comprises at least one layer, the at least one layer defining a first surface and a second surface, wherein the first surface comprises a first set of apertures and the second surface comprises a second set of apertures. The apertures of the first set of apertures may be referred to as first apertures, the apertures of the second set of apertures may be referred to as second apertures. Each first aperture has a respective first cross-sectional area (or "first area") and each second aperture has a respective second cross-sectional area (or "second area"). Any second cross-sectional area is smaller than any first cross-sectional area.

The cross-sectional areas may also be characterized by respective opening sizes. Accordingly, it may be said that each first aperture has a respective first opening size and each second aperture has a respective second opening size, wherein any second opening size is smaller than any first opening size.

In some examples, all first areas may be substantially identical, while in other examples at least two first areas may differ from one another. Similarly, in some examples, all second areas may be substantially identical, while in other examples at least two second areas may differ from one another. All combinations between the examples for the first area and the second areas are possible.

In a particular example, the textile may comprise a first zone and a second zone. The first apertures in the first zone may have a first common first area and the first apertures in the second zone may have a second common first area, wherein the second common first area is larger than the first common first area. Additionally or alternatively, the second apertures in the first zone may have a first common second area and the second apertures in the second zone may have a second common second area, wherein the second common second area is larger than the first common second area.

The first apertures and the second apertures may be aligned, e.g. axially or laterally aligned. In other words, each first aperture may be aligned with a corresponding second aperture. As used herein, laterally aligned refers to a spatial relationship in which a first aperture and a corresponding second aperture are positioned to overlap when viewed along an axis normal to the plane of the first layer. That is, the apertures are aligned in the plane of the layers (e.g., in the X-Y plane), such that a portion or the entirety of each first aperture overlaps with a respective second aperture in the lateral direction.

There may be a hydrophobic gradient between the first surface and the second surface, the direction of the gradient being from the first surface to the second surface. The second surface may be more hydrophobic than the first surface, or, said otherwise, the first surface may be more hydrophilic than the second surface.

The at least one layer may be a knit layer, a nonwoven layer, a woven layer or a combination thereof.

The at least one layer may comprise a single layer. Alternatively, the at least one layer may comprise a first layer and a second layer, wherein the first layer comprises the first surface and the second layer comprises the second surface. The textile may be a knit spacer textile, wherein the first layer is a first knit layer, the second layer is a second knit layer, and wherein the textile further comprises a plurality of tie yarns interconnecting the first knit layer and the second knit layer.

In one example aspect, the knit spacer textile may be a warp-knit textile. In one example, the warp-knit textile comprises a tricot knit spacer textile. The warp-knit textile may have a machine direction and a cross-direction, which is perpendicular to the machine direction. These directions may affect the mechanical properties of the fabric (e.g., stretch, strength, drape, etc.).

In example aspects, the textile is a knit spacer textile that includes a first knit layer formed from a first plurality of yarns. The first knit layer includes a first set of apertures, each aperture having a first opening size. The knit spacer textile further includes a second knit layer formed from a second plurality of yarns. The second knit layer includes a second set of apertures. Each aperture in the second set of apertures may be axially aligned with a corresponding aperture in the first set of apertures. Each aperture in the second set of apertures has a second opening size that, in examples, is smaller than the first opening size of apertures in the first set of apertures. A plurality of tie yarns interconnect the first knit layer and the second knit layer.

In other example aspects, the textile may comprise a double layer knit textile having a first knit layer with a first set of apertures, each aperture having a first opening size. The double layer knit textile further includes a second knit layer having a second set of apertures, each aperture having a second opening size smaller than the first opening size. The second knit layer is positioned adjacent to the first knit layer such that apertures in the second set of apertures are axially aligned with corresponding apertures in the first set of apertures.

The double layer knit textile may comprise, for example, two separate textiles that are joined together in one or more locations to maintain the axial alignment of the apertures in the first and second knit layers. For example, the first and second knit layers may be bonded or adhered together to form a composite textile. In another example, the first and second knit layers may be secured to each other using stitching or other types of affixing technologies. In a different example, the double layer textile may comprise a double knit textile with yarns transferring back and forth from the first knit layer to the second knit layer in order to secure the two layers to each other.

Aspects herein also contemplate using non-knit technologies to form a layer of the textile, in particular a layer of the double layer textile. For example, one or more of the first layer and the second layer may comprise a nonwoven textile formed from fibers having desired properties as described below. The first layer may include a first set of apertures each having a first opening size, and the second layer may include a second set of apertures each having a second opening size smaller than the first opening size. The first layer may be secured to the second layer in such a way that the first and second set of apertures are axially aligned. When the first and second layers comprise a nonwoven textile, the securement of the layers may be through entanglement (e.g., needle entanglement, hydroentanglement) and/or through use of an adhesive, heat and pressure, and the like.

Aspects herein further contemplate using woven textiles (e.g., a first woven layer and a second woven layer interwoven with each other or secured using an adhesive, bonding, and the like) having the features described above with respect to the apertures. In examples, layers having different constructions (e.g., knit, woven, or nonwoven) may be combined with each other (e.g., a knit layer combined with a woven layer, a nonwoven layer combined with a knit layer, a nonwoven layer combined with a woven layer, and the like).

Aspects herein further yet contemplate using a single layer textile that has relatively high absorbency characteristics and applying a finish to one side of the textile to impart hydrophobic characteristics. For example, the single layer textile may comprise a 100% cellulose textile that is treated on one side or surface with a durable water repellent finish. In this example, the single layer textile may optionally comprise apertures having a uniform diameter and/or apertures that have a funnel-like structure (i.e., a tapering diameter) as they extend from the absorbent side of the textile to the hydrophobic side of the textile.

When the textile is incorporated into the garment, the first layer forms an outer-facing surface including an outermost-facing surface of the garment, and the second layer forms an inner-facing surface including an innermost-facing surface of the garment. As such, the larger-sized apertures are located on the outermost-facing surface of the garment and the smaller-sized apertures are located on the innermost-facing surface of the garment. Because the first and second sets of apertures are axially aligned, they create a funnel-type structure. Air that is moving over the outermost-facing surface of the garment may enter the first set of apertures, and the air may speed up as it flows through the smaller-sized second set of apertures. Described differently, the size and configuration of the first and second sets of apertures may create a Venturi effect that facilitates an increase in air flow velocity through the apertures into an interior volume enclosed by the garment, thereby enhancing breathability and cooling.

In one example, speed of air increases as it passes through the continuous openings formed through the first and second layer of the knit spacer textile. In one example, the velocity of air passing through the continuous openings in the textile remains elevated at least within the first two millimeters behind the textile. Thus, a wearer should experience greater cooling when wearing a garment made from the textile described herein even when the textile rests against the skin of the wearer (e.g., there does not need to be a gap between the wearer and the textile to promote increased cooling). In examples where the ambient air from the environment is cooler than the wearer's body temperature, the faster-moving air may then flow over the surface of a wearer's body, and heat from the wearer's body may be transferred to the relatively fast flowing air which facilitates wearer cooling by way of, for example, convective cooling.

This cooling feature may be contrasted with more traditional garments that utilize perforations to try and cool a wearer. In examples with traditional garments, because the perforations comprise holes having a consistent opening size or diameter as the perforation extends through the textile, air entering the garment from the outside may not speed up as the air flows through the perforation. As such, air flow around the wearer's body may be relatively reduced compared to the aperture configuration described herein, and, as a result, wearer cooling through convective cooling may be relatively reduced.

With respect to the textile described herein, aspects herein further contemplate selecting yarn or fiber types to form the textile to further improve cooling features of the textile. In example aspects, the first plurality of yarns, the second plurality of yarns, and the plurality of tie yarns may comprise the same yarn type or different yarn types or some yarn types may be the same and some may be different (e.g., the first and second plurality may be the same yarn type while the tie yarns may be different, or the tie yarns may be the same yarn type as the first or second plurality of yarns but not the other). For example, the yarn or fiber types used to form the textile described herein may comprise polyester, recycled polyester, nylon, recycled nylon. In other examples, the yarn or fiber types used to form the textile described herein may comprise other yarn or fiber types described herein.

In example aspects, the first plurality of yarns used to form the first knit layer may comprise absorbent yarns (i.e., yarns that have a relatively high moisture regain) that hold moisture. In some aspects, the yarns may comprise natural fibers such as, for example, cotton, wool, and the like. The second plurality of yarns used to form the second knit layer may comprise yarns that are relatively more hydrophobic (i.e., yarns that have a relatively lower moisture regain) than the first plurality of yarns. When the use of natural and/or semi-synthetic yarns is desired, a cellulose yarn such as viscose or LYOCELL® may be used. Creating a relatively hydrophobic surface next to the wearer's skin may improve wearer comfort by minimizing the feel of wet material touching the skin surface. The plurality of tie yarns may be selected to facilitate the transport of moisture from the second knit layer to the first knit layer. For instance, the plurality of tie yarns may have features that facilitate moisture wicking or transport. In aspects, one or more of the first plurality of yarns, the second plurality of yarns, and the plurality of tie yarns may comprise Drawn Textured Yarn (DTY). Using DTY may provide for better air circulation and moisture transport away from the skin. Again, when the use of natural and/or semi-synthetic yarns is desired, the plurality of tie yarns may include, for example, wool (e.g., merino wool), alpaca, and the like.

The selection of yarns described above creates a hydrophilic gradient or a push/pull effect that pushes moisture from the relatively hydrophobic first knit layer to the relatively hydrophilic second knit layer via the moisture-wicking tie yarns. This push/pull moisture transport effect improves the breathability of the textile by facilitating both air exchange and moisture vapor transmission away from the wearer's skin. Once the moisture has been transported to the second knit layer, it may be stored in the second knit layer.

In examples where the ambient air is warmer than the wearer's body temperature, air that enters the textile by way of the apertures may be cooled by way of evaporative cooling from the moisture stored in the second knit layer. For example, the heat of the ambient air may help evaporate the perspiration stored in the second knit layer (e.g., the air helps to evaporate the liquid perspiration into a vapor). When this occurs, the textile may cool as well as the air passing through the now cooler textile. The result is that the air that is passing through the textile will be at a lower temperature than the ambient air external to the textile thus helping to cool the wearer through enhanced evaporative cooling.

The selection of yarns is also important in providing a textile, and a garment constructed from the textile, that has a desirable amount of drape (e.g., rigidity) when donned. As used herein, the term "drape" refers to the tendency of a textile to conform to the shape of a wearer's body and/or respond to movement. A textile with higher drape may exhibit localized displacement and flow around curved surfaces, while a textile with lower drape (i.e., greater rigidity) may move more uniformly as a single structure. Adjusting the drape characteristics of a textile affects not only garment fit and comfort but also its ability to maintain airflow and breathability. This drape (e.g., rigidity) influences how the textile hangs on the body and contributes to maintaining separation between the garment and the skin. By preventing excessive cling, the textile allows airflow along the skin surface and facilitates breathability, including through the first and second plurality of apertures.

A number of yarn characteristics are important in providing a suitable drape (e.g., rigidity), such as the yarn denier, the yarn tenacity, the yarn moisture regain percentage, the yarn denier per filament, among others. These yarn characteristics will be discussed below in greater detail. A number of textile characteristics are also important in providing suitable drape (e.g., rigidity), such as stiffness and thickness of the textile. These textile characteristics will be discussed below in greater detail.

The yarns used herein (e.g., for a first knit layer, a second knit layer, tie yarns, etc.) may have a variety of deniers. As noted above, the yarns or fibers used to form the textile described herein may be the same for the first layer, the second layer and the tie yarns, or may be same in part and different in part, or they may be all different from one another. This may be the case not only for the yarn or fiber material type but also for the characteristics of the yarn or fiber (e.g., the denier, or any other characteristic or parameter discussed herein). For example, the yarns used herein may have a denier of at least 70D. Some aspects may use yarns having a denier in the range of 70D-160D. One aspect may use a yarn having 80D.

Similarly, the yarns used herein may have a variety of tenacities. For example, the yarns used herein may have a tenacity of 4 grams/denier. In another example, the yarns may have a tenacity in the range of about 3.6 to about 4.8 grams/denier. In still another example, the yarns may have a tenacity in the range of about 3.0 to about 5.0 grams/denier.

Likewise, the yarns used herein may have a variety of moisture regain percentages. For example, the yarns may have a moisture regain of about 10%. Some aspects may use yarns having a moisture regain in the range of about 9% to about 13%. One aspect may use a yarn having a moisture regain of 9.9%.

Further, the yarns used herein (e.g., for the first layer, the second layer an/or the tie yarns, and any and all combinations thereof) may have a variety of denier per filament. Generally, a higher denier per filament results in a stiffer (e.g., more rigid yarn). As discussed below, stiffness (e.g., rigidity) of the yarns used herein can affect how much a textile drapes when donned by a wearer. If the textile is too stiff, it may not be comfortable to wear. If the textile is not stiff enough, it may drape too much (i.e. cling to a wearer too closely) which also may not be comfortable to wear. Balancing the need for stiffness and comfort has resulted in determining a particularly useful range of denier per filament yarns. For example, the yarns may have a denier per filament in the range of 0.5 to 2.5 and provide the stiffness desired for the textile and garments disclosed herein. Some aspects that require increased stiffness may use yarns having a denier per filament in the range of 1.5 to 2.5. In some aspects, the yarns may have a denier per filament of about 2.08. Other aspects having less stiffness may use yarns having a denier per filament in a range from 0.75 to 1.4. In some aspects, the yarns may have a denier per filament of about 1.04. Still other aspects having even less stiffness may use yarns having a denier per filament of less than 0.75.

Stiffness of the textile may be measured using the circular bend procedure set forth in ASTM D4032-2008, which computes an average force for the textile in units of kilograms force (e.g., kgf). Apparel textiles may have a wide range of stiffnesses. For example, some apparel textiles have a stiffness in the range of 0.02-0.60 kgf. A textile that is too stiff will not fit the form of the wearer and may be uncomfortable. In addition, the moisture produced by perspiration may not be effectively transported to the outer knit layer if the textile is too stiff and not occasionally in contact with a wearer's body. On the other hand, a textile that is not stiff enough may be too drapey (i.e., it may cling to the wearer or be too form fitting). If a textile is not stiff enough, the air flow between the wearer and the inner layer of the textile may be restricted. In either case, being too stiff or not stiff enough can result in decreased cooling to the wearer.

The textiles used herein may have a stiffness with an average force of 0.101 kgf. In another example, the textiles used herein may have an average force in the range of about 0.09 kgf to about 0.11 kgf. In yet another example, the textiles used herein may have an average force in the range of about 0.07 kgf to about 0.13 kgf. In another example, the textiles used herein may have an average force in the range of about 0.05 kgf to about 0.3 kgf. Maintaining stiffness within this range enhances breathability and promotes improved airflow into/out of a space enclosed by the textile. For example, the textile is less likely to cling to a wearer's body, even when wet, thereby allowing ambient air to circulate and supporting increased airflow velocity across the skin.

Thickness of the textile may be measured using the procedure set forth in ASTM D1777-2019, Option 5, in some aspects. Thickness of the textile may also be measured using the procedure set forth in ISO 5084-1996. The thickness of the textile also impacts how much drape the textile has. Both low-loft textiles and high-loft textiles are useful as described herein. Low-loft textiles used herein may have a thickness of 1.38 mm as measured under the ASTM standard or 1.75 mm as measured under the ISO standard, in accordance with one example. In another example, the textile used herein may have a thickness in the range of about 1.35 mm to about 1.42 mm under the ASTM standard or about 1.70 mm to about 1.80 mm under the ISO standard. In yet another example, the textile used herein may have a thickness in the range of about 1.10 mm to about 1.60 mm under the ASTM standard or about 1.50 mm to about 2.10 mm under the ISO standard.

In contrast to the low-loft constructions described above, higher-loft textiles may be used to provide enhanced airflow pathways, increased structural separation between knit layers, or improved thermoregulatory function. In some aspects, the thickness of such textiles may be about 6.35 mm, or fall within a range of about 5.1 mm to about 7.6 mm. In broader implementations, the thickness may range from about 3.8 mm to about 8.9 mm. Overall, useful spacer textile constructions may include both low-loft and high-loft configurations, with thickness values ranging from about 1.05 mm to about 12.7 mm, as measured according to ASTM D1777-2019 or ISO 5084-1996. In aspects, the thickness values provided herein comprise an average thickness across the textile. Selection of thickness may depend on the desired balance of drape, breathability, cushioning, or garment fit.

When a double-layer knit textile is used, the first knit layer may also be formed from relatively absorbent yarns and the second knit layer may be formed from yarns that are more hydrophobic than the yarns in the first knit layer. This configuration also produces a push/pull effect such that moisture is pushed from the relatively hydrophobic first knit layer directly to the relatively hydrophilic second knit layer. When the textile comprises a nonwoven construction, fibers that are used to form the first nonwoven layer may be relatively more hydrophilic compared to the fibers that form the second nonwoven layer to again create a push/pull effect. When the textile comprises a woven construction, yarns used to form the first woven layer may be relatively more hydrophilic compared to the yarns that form the second woven layer.

As used herein, the term "apparel item," "garment," or "athletic apparel item or garment," means a garment configured to be worn by a wearer. In example aspects, the garment may be worn while the wearer engages in athletic activities. The garment may be in the form of a lower-body garment, that in some aspects may be form-fitting, such as a legging, tight, capri, short, and the like; an upper-body garment, that in some aspects may be form-fitting, such as a shirt or pullover; a support garment such as a sport bra or sport tank, and the like.

The term "outer-facing surface" when referring to the garment means the surface facing away from the body of a wearer and toward the external environment. The term "inner-facing surface" when referring to the garment means the surface facing inwardly or toward the body of the wearer. The term "outermost-facing surface" means the surface that is located farthest away from the body of the wearer with respect to other layers or components of the garment, and the term "innermost-facing surface" means the surface that is located closest to the body of the wearer with respect to other layers or components of the garment.

The term "knit spacer textile," as used herein is meant to encompass both warp knit and weft knit spacer textiles as is known in the art of textiles. Spacer textiles are generally formed by utilizing at least one tie yarn to interconnect first and second knit layers of the textile. More specifically, each of the first layer and the second layer may be knit separately, and the tie yarn(s) is used to connect the first knit layer and the second knit layer. For instance, the tie yarns may have "loop" portions that extend into each of the first knit layer and the second knit layer where the loop portions are interlooped with yarns in the first knit layer and the second knit layer to connect the two layers.

Because each of the first knit layer and the second knit layer are knit separately, whether simultaneously or sequentially, on the same machine or different machines, and whether or not integrally formed with the tie yarns, each layer may be constructed using different yarn types and/or different knit constructions, although the same yarn types and constructions may also be used for both layers. In addition, the tie yarns used to interconnect the layers may be formed from the same or different yarn types as those used in either knit layer. Within a given knit layer, a particular yarn may extend throughout at least a portion of that knit layer. To differentiate a knit spacer textile from a double-knit textile, a criterion may be whether a transfer of yarns occurs. In a double-knit textile, there is a transfer of yarns from the face layer to the back layer and vice versa. In a knit spacer textile, there is not a transfer of yarns from the first knit layer to the second knit layer. Stated differently, yarns forming the first knit layer are separate and distinct from yarns forming the second knit layer, and the first and second knit layers are generally only connected by way of the tie yarns.

As used herein, the term "nonwoven textile" refers to fibers that are held together by mechanical and/or chemical interactions without being in the form of a knit, woven, braided construction, or other structured construction. In a particular aspect, the nonwoven textile includes a collection of fibers that are mechanically manipulated to form a mat-like material. Stated differently nonwoven textiles are directly made from fibers. The nonwoven textile may include, for example, two nonwoven layers secured together using entanglement of fibers of the two layers (e.g., needle entanglement, hydroentanglement), adhesives, bonding, stitching, and the like. The different nonwoven layers may be formed of fibers having different properties (e.g., more absorbent fibers, less absorbent fibers, and the like).

The term "moisture regain" as used herein is the amount of moisture that a material (e.g., a fiber or yarn) is able to reabsorb after it has been dried and is expressed as a weight/weight percentage (w/w %) of water in a fiber versus the fiber's dry weight. The term "moisture-wicking" refers to the ability of fibers or a yarn formed from fibers to move moisture through capillary action. The capillary action typically moves moisture between fibers in a yarn. The moisture-wicking features may be imparted by characteristics of the fibers itself. For example, merino wool fibers typically have a hydrophobic wax on the outer surface of the fiber that helps to repel moisture and forces the moisture to move between the fibers by capillary action. In another example, the fibers may have an irregular shape (e.g., a trilobal cross-section shape, crimped fibers, and the like) that creates spaces between bundled fibers through which moisture is transported by capillary action.

As used herein, the term "breathability" refers to the ability of a textile or garment to permit the passage of air and/or moisture vapor through its structure. Increased breathability may result from structural features such as apertures, fabric porosity, zonal variations in material construction, or the selection of yarns and fibers that promote airflow and moisture transport. Breathability may contribute to enhanced wearer comfort by facilitating convective and/or evaporative cooling.

The term "aperture opening size" is dependent on the shape of the aperture. When the aperture is a circle, the aperture opening size is the length of a straight line passing from one side of the aperture to a second side of the aperture through the center of the aperture (i.e., the diameter). When the aperture is ovoid in shape, the aperture opening size is taken along the semi-major axis of the oval. When the aperture has an irregular shape, aspects herein contemplate that the aperture opening size are the longest dimension from one side of the aperture to the other side of the aperture with the line passing through a determined center of the shape.

The term "axially aligned" as used herein refers to the centers of, for example, a first aperture in the first set of apertures and a second aperture in the second set of apertures being along the same line in space. Described differently, the centers of the apertures are co-linear. In aspects, the axial alignment described herein may be present after the knitting process is completed. In some aspects, however, the axial alignment may be askew from the description above (i.e., the centers of the apertures may not be co-linear) after one or more post-knitting processing steps has occurred to the textile (e.g., heat setting, heat pressing, molding, etc.).

The term "about" as used herein means within ±5% of an indicated value.

Unless otherwise noted, all measurements provided herein are measured at standard ambient temperature and pressure (25 degrees Celsius or 298.15 K and 1 bar) with the knit spacer textile in a resting (un-stretched) state. Unless otherwise specified, dimensional values described herein may include a manufacturing tolerance of approximately ±5% to account for acceptable production variability. In some aspects, the textile and garment structures described herein may exhibit dimensional changes over time (e.g., due to washing or repeated use), including shrinkage of up to approximately 5%, without substantially affecting performance characteristics such as breathability, airflow, or fit.

FIG. 1A depicts an example knit spacer textile 100. The knit spacer textile 100 includes a first knit layer 110 extending in an x, y plane and a second knit layer 112 extending in an x, y plane, where the second knit layer 112 is parallel to and offset or spaced apart from the first knit layer 110 by a plurality of tie yarns 114 that are interknitted with the first knit layer 110 and the second knit layer 112. Although only one tie yarn 114 is depicted, it is contemplated herein that more than one tie yarn 114 may be used to interconnect the first knit layer 110 and the second knit layer 112.

The portions of the tie yarn 114 indicated by reference numerals 113 and 115 and shown in dashed lines to indicate they are generally hidden from view represent those areas of the tie yarn 114 that are interlooped with the yarns forming the first knit layer 110 and the second knit layer 112 respectively. As used throughout this disclosure, the term "loop" or "loop portion" when referring to tie yarns refers to the portion of the tie yarn that extends into the first knit layer 110 and the second knit layer 112 and is interlooped with yarns in the first knit layer 110 and the second knit layer 112.

Figure 2:
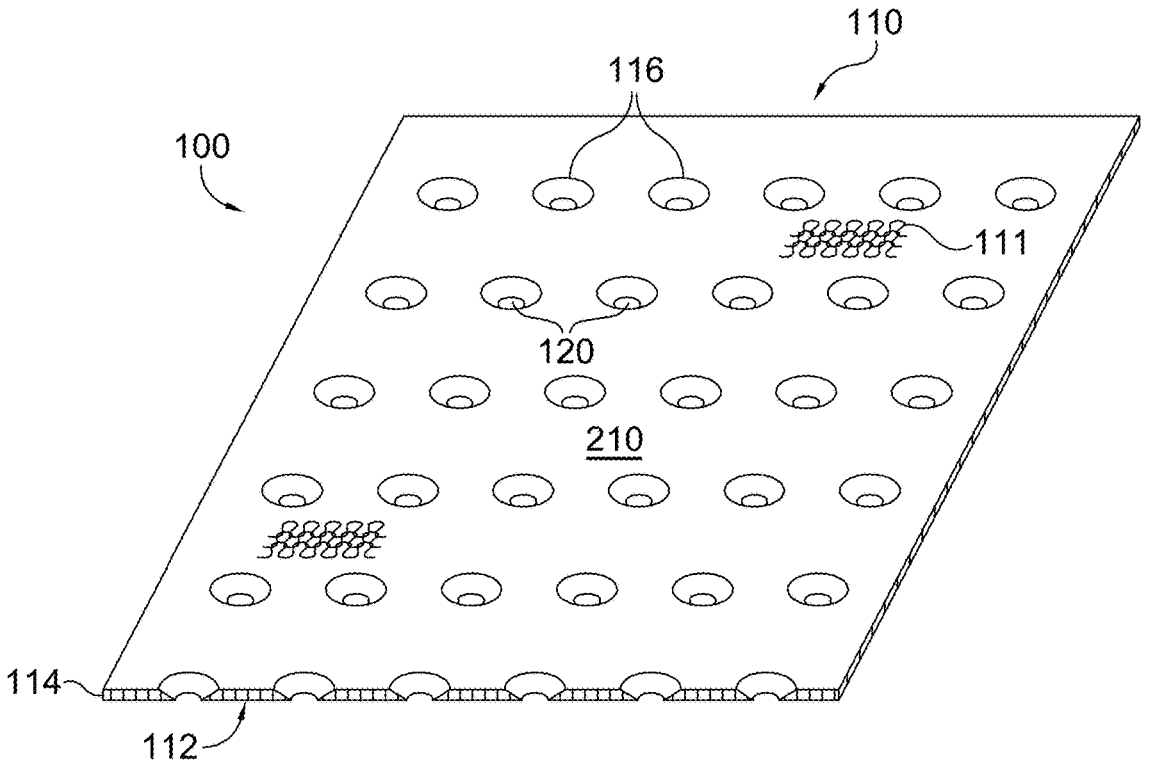
FIG. 2 illustrates a first surface formed by a first knit layer of the knit spacer textile of FIG. 1A in accordance with aspects herein.
Figure 3:
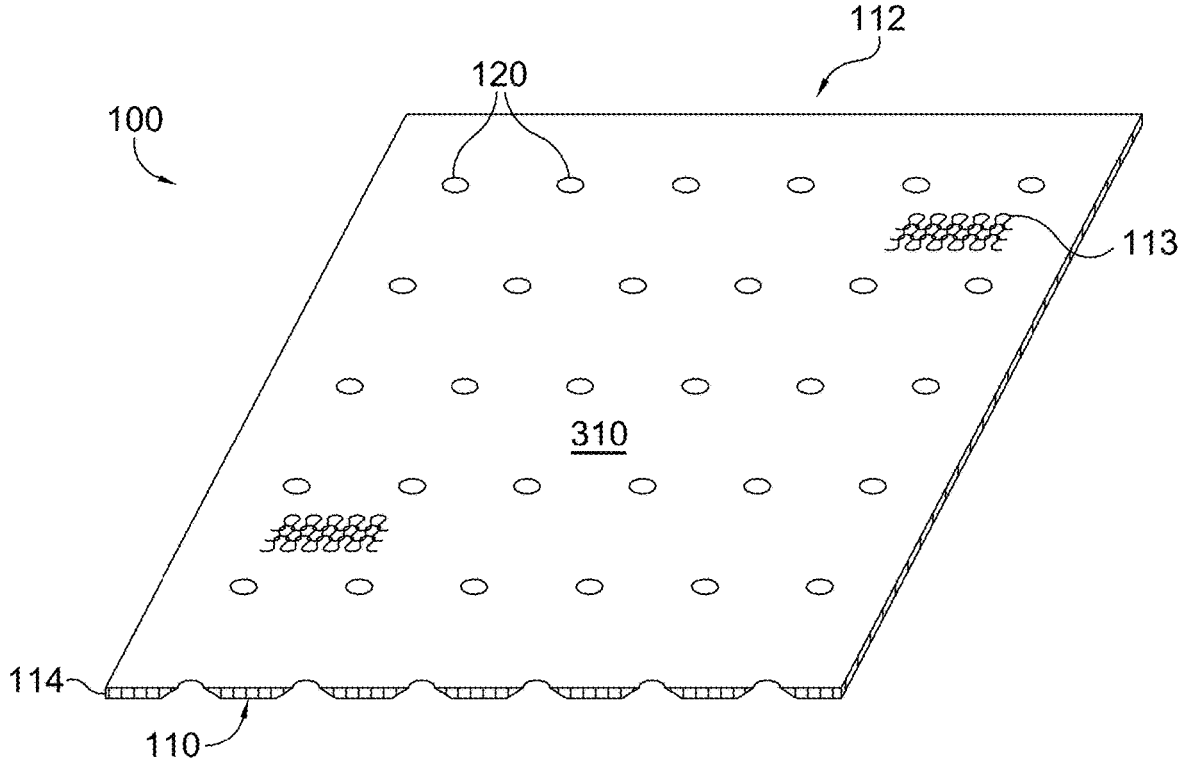
FIG. 3 illustrates a second surface formed by a second knit layer of the knit spacer textile of FIG. 1A in accordance with aspects herein.

Discussion regarding the yarns used to form the first knit layer 110 and the second knit layer 112 will be provided with respect to FIGS. 2 and 3. In example aspects, the plurality of tie yarns 114 may be selected to provide moisture wicking capabilities. Some examples of natural fibers that are moisture wicking include wool, including merino wool, alpaca wool, and the like (e.g., natural protein fibers comprised of keratin). Other examples may use cellulosic natural fibers including cotton, flax, hemp, and the like. Still other examples may use semi-synthetic fibers such as LYOCELL®, viscose, and the like (e.g., natural cellulose that's chemically processed into a liquid and reformed into fibers). Aspects herein also contemplate using synthetic fibers such as polyester, recycled polyester, nylon, spandex, elastane, LYCRA® and the like. Aspects also contemplate using DTY, which may provide sufficient rigidity to the textile such that garments formed from the textile may have a beneficial amount of drape (e.g., rigidity) while also having beneficial moisture wicking to move perspiration from the second knit layer 112 to the first knit layer 110.

In some examples, the tie yarns 114 define the overall thickness of the knit spacer textile 100 by spanning between the first knit layer 110 and the second knit layer 112. The length of the tie yarns 114 (i.e., the height of the spacing structure) directly impacts the textile's loft and, therefore, its drape, breathability, and structural performance. By adjusting the length of the tie yarns, the textile may be engineered to achieve the desired balance between flexibility, structural recovery, and airflow management. The ability to tailor tie yarn length allows for fine-tuning of how the textile conforms to the body and interacts with adjacent garment layers, supporting a wide range of thicknesses described above.

The knit spacer textile 100 further includes apertures. For example, the first knit layer 110 includes a first set of apertures 116 that extend through a thickness of the first knit layer 110. Each aperture, such as aperture 116*a* has a first opening size 118. The first opening size 118 may be approximately the same (e.g., within ±1 to 2 mm of each other) for each aperture in the first set of apertures 116. In other aspects, the first opening size 118 may vary for one or more apertures in the first set of apertures 116. In examples, the knit spacer textile 100 may include a first zone comprising one or more apertures in the first set of apertures 116 having the first opening size 118 and a second zone comprising one or more apertures in the first set of apertures 116 having a different opening size larger than the first opening size 118. The first opening size 118 may be from about 5 mm to about 2 cm.

In examples, the knit spacer textile 100 may include a first zone comprising one or more apertures in the first set of apertures 116 spaced apart from one another a first distance across the first knit layer 110 and a second zone comprising one or more apertures in the first set of apertures 116 spaced apart from one another a second distance across the first knit layer 110, the first distance different than the second distance. In aspects, each aperture in the first set of apertures 116 may be spaced apart from an adjacent aperture by about 2 mm to about 8 mm, or about 4 mm to about 7 mm.

By varying the aperture sizes and/or the aperture spacing between zones (e.g., first zone and second zone), the knit spacer textile 100 may be engineered to provide zones of increased breathability in regions corresponding to higher heat or perspiration generation. For example, one or more zones may include a greater aperture density (e.g., apertures per unit area) to promote air exchange and moisture vapor transmission in those regions. Some examples may include a first knit layer 110 having about 1.5 to about 25 apertures per square centimeter.

In examples, the first knit layer 110 may comprise a knit layer having a machine direction and a cross direction. As discussed herein, the first set of apertures 116 may be formed in the first knit layer such that they have an oblong shape with a first diameter aligned with the machine direction and a second diameter aligned with the cross direction. In aspects, the first diameter may be about 5 mm to about 22 mm and the second diameter may be about 2 mm to about 10 mm. In other aspects, the first diameter may be about 12 mm to about 19 mm and the second diameter may be about 4 mm to about 8 mm. In still other aspects, the first diameter may be about 16.25 mm to about 17.25 mm and the second diameter may be about 5.5 mm to about 6.5 mm. In these examples, the aperture area of the first set of apertures 116 may range from about 7.85 $mm^2$ to about 172.8 $mm^2$, or from about 37 $mm^2$ to about 119 $mm^2$, or from about 70 $mm^2$ to about 88 $mm^2$.

The second knit layer 112 includes a second set of apertures 120 that extend through a thickness of the second knit layer 112. Each aperture, such as aperture 120*a* has a second opening size 122. The second opening size 122 may be approximately the same (e.g., within +1 to 2 mm of each other) for each aperture in the second set of apertures 120. In other aspects, the second opening size 122 may vary for one or more apertures in the second set of apertures 120. In examples, the knit spacer textile 100 may include a first zone comprising one or more apertures in the second set of apertures 120 having the second opening size 122 and a second zone comprising one or more apertures in the second set of apertures 120 having a different opening size larger than the second opening size 122. The second opening size 122 may be from about 2 mm to about 1.5 cm, or from about 4 mm to about 1.3 cm.

The second opening size 122, in example aspects, may be different from the first opening size 118 of the first set of apertures 116. In example aspects, the second opening size 122 is smaller than the first opening size 118. For example, the first opening size 118 may be at least about 1.25 to about 2.5 times greater than the second opening size 122, or about 1.5 to 2.0 times greater than the second opening size 122. In examples, the knit spacer textile 100 may include a first zone comprising one or more apertures in the second set of apertures 120 spaced apart from one another a first distance across the second knit layer 112 and a second zone comprising one or more apertures in the second set of apertures 120 spaced apart from one another a second distance across the second knit layer 112, the first distance different than the second distance. In aspects, each aperture in the second set of apertures 120 may be from about 2 mm to about 1 cm from an adjacent aperture, or from about 4 mm to about 7 mm from an adjacent aperture.

By varying the aperture sizes or the aperture spacing between zones (e.g., the first zone and the second zone), the knit spacer textile 100 may be engineered to provide zones of increased breathability in regions corresponding to higher heat or perspiration generation. For example, one or more zones of the second knit layer 112 may include a greater aperture density (e.g., apertures per unit area) to facilitate enhanced air exchange, evaporative cooling, and localized moisture management. Some examples may include a second knit layer 112 having about 1.0 to about 25 apertures per square centimeter.

In examples, the second knit layer 112 may comprise a knit layer having a machine direction and a cross direction. As discussed herein, the second set of apertures 120 may be formed in the second knit layer such that each aperture has an oblong shape with a first diameter aligned with the machine direction and a second diameter aligned with the cross direction. In aspects, the first diameter may range from about 2 mm to about 15 mm and the second diameter may range from about 1 mm to about 10 mm. In other aspects, the first diameter may range from about 5 mm to about 9 mm and the second diameter may range from about 3 mm to about 6 mm. In still other aspects, the first diameter may range from about 7 mm to about 7.75 mm and the second diameter may range from about 4.5 mm to about 5.25 mm. In these examples, the aperture area of the second set of apertures 120 may range from about 1.57 $mm^2$ to about 117.8 $mm^2$, or from about 11.8 $mm^2$ to about 42.4 $mm^2$, or from about 24 $mm^2$ to about 31.9 $mm^2$.

Each aperture in the second set of apertures 120 may be axially aligned with a corresponding aperture in the first set of apertures 116 such that a through passage is formed through a thickness of the knit spacer textile 100. This is shown, for example, by axial alignment line 124 that extends through a center of the aperture 116*a* and through a center of aperture 120*a*. Because the second opening size 122 is smaller than the first opening size 118, the through passage narrows as it extends from the first knit layer 110 through the second knit layer 112 to form a funnel-like structure. As described further below, the funnel-type structure may cause air that is flowing through the through passage to speed up as it moves from the first knit layer 110 to the second knit layer 112. Also as further described below, the funnel-type structure may include sidewalls defined by the tie yarns 114.

In aspects the tie yarns 114 may extend perpendicularly to either or both of the first knit layer 110 and the second knit layer 112. In further aspects, some of the tie yarns 114 may extend at an angle less than ninety degrees from either or both of the first knit layer 110 and the second knit layer 112 (referred to herein as extending at an angle to such knit layers). When at least some of the tie yarns 114 extend at an angle to either or both of the first knit layer 110 and the second knit layer 112, the axially-aligned apertures are provided with a funnel-type structure.

Said another way, the axially-aligned apertures may present a beveled edge. Depending on the number and spacing of the tie yarns 114 that extend at an angle, the beveled edge may appear as a solid beveled edge (or surface) or define an effective beveled edge (or surface). As used herein, a solid beveled edge or surface refers to an edge or surface that is substantially continuous and uniform, without significant interruptions, voids, or gaps, such that it presents a generally unbroken contour in appearance and function. In contrast, an effective beveled edge or surface refers to an edge or surface that, although it may include spaces, gaps, or discontinuities, still performs the functional role of a beveled edge or surface-such as guiding, deflecting, or supporting material-when viewed or used as intended. In examples, this beveled edge may have a constant angle relative to one or both of the first knit layer 110 and the second knit layer 112. In further examples, this beveled edge may have a variable angle around its perimeter relative to one or both of the first knit layer 110 and the second knit layer 112. That is, the tie yarns at one position around the perimeter extend at an angle nearer ninety degrees than do tie yarns at another position around the perimeter. For example, in the context of a warp knitted knit spacer textile having a machine direction and a cross direction, the beveled edge presented on the cross direction ends may be less sloped than the beveled edge presented on the machine direction ends.

This structure occurs when tie yarns 114 extend from a position adjacent an aperture in the first knit layer 110 to a position adjacent an aperture in the second knit layer 112. When viewed from the first knit layer 110 side, these tie yarns 114 are visible through the aperture in the first knit layer 110 (but would be obstructed from view through the aperture in the second knit layer 112).

Although described as a funnel-type structure, this description is not limited to a set of circular apertures having a constant diameter. As described below, the first set of apertures 116 and/or the second set of apertures 120 may have a variety of shapes (e.g., circular, oblong, ovular, elliptical, spindle shaped rectangular, regular, irregular, etc.), which need not match one another. In such cases, the funnel-type structure may not have a constant diameter, merely a reducing cross-sectional area from the first knit layer 110 to the second knit layer 112.

In other aspects, the first set of apertures 116 may not be axially-aligned with the second set of apertures 120. For example, in these aspects the center of aperture 116*a* may not be axially-aligned with the center of aperture 120*a*. In some aspects, corresponding apertures may be partially-aligned (e.g., the aperture 116*a* may partially overlap the aperture 120*a*, when viewed from above).

In other aspects, corresponding apertures may be offset from one another such that they do not overlap. In these non-axially aligned aspects, air may enter an aperture of the first set of apertures 116 and pass through a space between the first knit layer 110 and the second knit layer 112 before passing through one or more apertures of the second set of apertures 120.

The depiction of the knit spacer textile 100 shown in FIG. 1A is illustrative only. For example, it is contemplated herein that the first knit layer 110 and the second knit layer 112 may be positioned closer to each other than shown. As well, the orientation of the tie yarns 114 may be different than that shown. For example, some or all of the tie yarns 114 may be oriented generally perpendicular to the x, y plane of the first knit layer 110 and the second knit layer 112 or some or all of the tie yarns 114 may be oriented at angles less than 90 degrees. Any and all aspects, and any variation thereof, are contemplated as being within the scope herein.

In one example, a first plurality of tie yarns at or near a periphery of the first set of apertures 116 of the first knit layer 110 and connecting the second knit layer 112 at or near a periphery of the corresponding second set of apertures 120 of the second knit layer 112 may be oriented at a more acute angle with respect to the x, y plane compared to an orientation of a plurality of tie yarns that interconnect the first and the second knit layers 110, 112 outside of the periphery of the apertures.

In another example, where the first set of apertures 116 of the first knit layer 110 and the second set of apertures 120 of the second knit layer 112 are the same size, the tie yarns 114 may be oriented at about 90 degrees.

The apertures may be formed in either of the first knit layer 110 or the second knit layer 112 in a variety of ways. For example, the apertures may be integrally formed through knitting or they may be removed from the textile layer (e.g., cutting, punching, penetrating, laser-cutting, etc.)

Figure 1B:
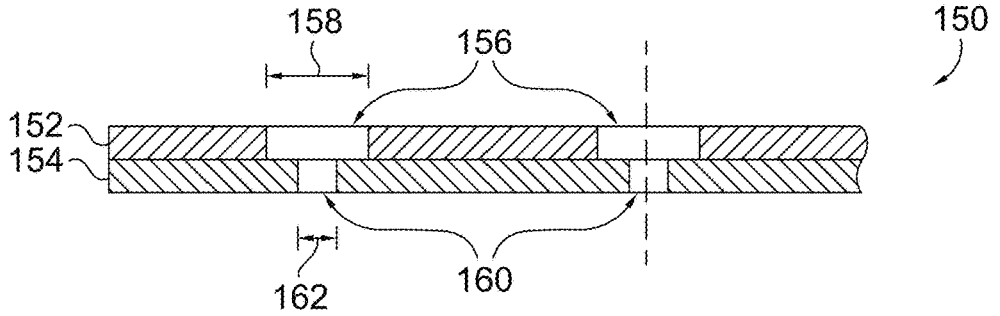
FIG. 1B illustrates a schematic cross-section view of a second example textile in accordance with aspects herein.

FIG. 1B depicts a schematic cross-section of a second example configuration for the textile described herein. In FIG. 1B, a textile 150 is depicted comprising a first layer 152 and a second layer 154 positioned adjacent the first layer 152. The first layer 152 may comprise, for example, a first knit layer of a double knit textile, a first nonwoven layer of a nonwoven textile, a first woven layer of a woven textile, and the like. The second layer 154 may comprise, for example, a second knit layer of the double knit textile, a second nonwoven layer of the nonwoven textile, a second woven layer of the woven textile, and the like. As also described above, different constructions (knit, woven, or nonwoven) may be combined with each other.

Depending on the structure of the first and second layers 152 and 154, the layers 152 and 154 may be secured to each other in a number of ways. For example, when the first and second layers 152 and 154 comprise a knit construction, the layers 152 and 154 may be secured adjacent to each other by way of yarns transferring from the first layer 152 to the second layer 154 and/or yarns transferring from the second layer 154 to the first layer 152 or secured to each other by way of bonding, an adhesive, and the like. When the first and second layers 152 and 154 comprise a nonwoven construction, the layer 152 and 154 may be secured to each other through entanglement, an adhesive, bonding, and the like. When the first and second layers 152 and 154 comprise a woven construction, the layer 152 and 154 may be interwoven with each other or secured to each other by way of bonding, an adhesive, and the like.

The first layer 152 comprises a first set of apertures 156 having a first opening size 158. The second layer 154 comprises a second set of apertures 160 having a second opening size 162 that is smaller than the first opening size 158. Each aperture in the first set of apertures 156 is axially aligned with a corresponding aperture in the second set of apertures 160. The aperture opening sizes and the spacing between adjacent apertures may be similar or the same to that described with respect to FIG. 1A.

Figure 1C:
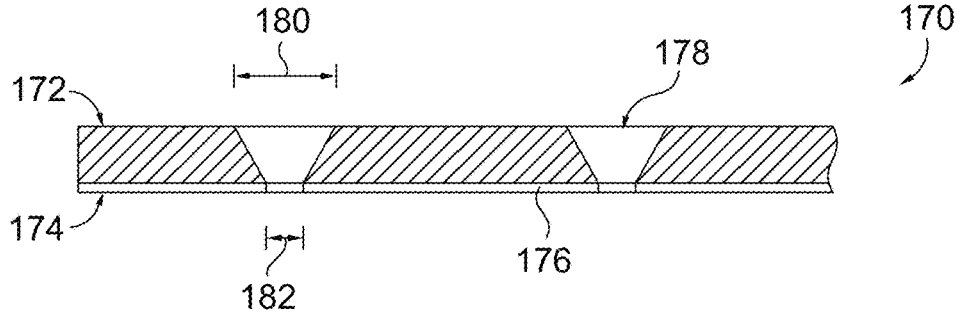
FIG. 1C illustrates a schematic cross-section view of a third example textile in accordance with aspects herein.

FIG. 1C depicts a schematic cross-section of a third textile 170 in accordance with aspects herein. In this example, the textile 170 comprises a single layer textile having a first surface 172 and an opposite second surface 174. When incorporated into a garment, the first surface 172 forms an outer-facing surface including an outermost-facing surface of the garment, and the second surface 174 forms an inner-facing surface including an innermost-facing surface of the garment. The textile 170 may comprise a knit construction (e.g., a single or double knit construction), a nonwoven construction, a woven construction, and the like.

In example aspects, a finish 176 may be deposited on the second surface 174 to help render the second surface 174 more hydrophobic than the first surface 172. For example, the finish 176 may comprise a durable water repellent. In another example, plasma vapor deposition may be used to impart hydrophobic characteristics to the second surface 174.

In examples, the textile 170 may comprise apertures 178 that extend through a thickness of the textile 170. In examples, the apertures 178 may be funnel shaped such that an aperture opening size 180 on the first surface 172 is larger than aperture opening size 182 on the second surface 174. The aperture opening sizes and the spacing between adjacent apertures may be similar or the same to that described with respect to FIG. 1A.

As discussed herein, each of the textiles 100, 150 and 170 may have a thickness. The thickness of said textile may affect how much rigidity the textile has. Said another way, the thickness of the textile may determine how much the textile drapes when the textile is donned by a wearer. For example, if a textile is too thin, it may drape too much which may lead to insufficient airflow in the space between the textile and the wearer. In some aspects, a textile having a thickness between 0.1 inches (2.54 mm) and 0.4 inches (10.16 mm) provides a useful amount of rigidity to the textile. In other aspects, the textile may have a thickness between 0.2 inches (5.08 mm) and 0.3 inches (7.62 mm). In another aspect, the textile may have a thickness of about 0.25 inches (6.35 mm). In other aspects, a textile having a thickness between 0.03 inches (0.762 mm) and 0.3 inches (7.62 mm) provides a useful amount of rigidity to the textile. In other aspects, the textile may have a thickness between 0.06 inches (1.524 mm) and 0.08 inches (2.032 mm). In another aspect, the textile may have a thickness of about 0.07 inches (1.778 mm).

FIG. 2 depicts a view of a first surface 210 of the knit spacer textile 100 formed by the first knit layer 110 of the knit spacer textile 100. Portions of the interlooped knit stitches forming the first knit layer 110 are depicted on the first surface 210. A first surface of the textile 150 and/or the textile 170 would have a similar appearance except that the first surface would comprise entangled fibers when the textile is a nonwoven textile or would comprise interwoven yarns when the textile is a woven textile. When incorporated into a garment, the first surface 210 would form an outer-facing surface and, in some aspects, an outermost-facing surface of the garment.

In the example shown in FIG. 2, the first set of apertures 116 is shown as generally circular in shape although other shapes are contemplated herein (e.g., oblong, ovular, elliptical, rectangular, spindle shaped, regular, irregular, etc.). The second set of apertures 120 on the second knit layer 112 is also visible in FIG. 2 as well as the plurality of tie yarns 114. The number of apertures depicted in FIG. 2, the size of the apertures, the arrangement of the first set of apertures 116, and the spacing between adjacent apertures is illustrative. Aspects herein contemplate an irregular arrangement of apertures, different spacing between adjacent apertures, different sizes for the apertures, a different number of apertures, and the like. For example, the irregular arrangement, different spacing, different sizes, different number, or other different character of apertures may change from a first zone of the textile to a second zone of the textile. In one aspect, the first zone may comprise an edge region of the textile (e.g., the area of the textile within three inches of the edge of the textile) and the second zone may comprise an interior region of the textile (e.g., an area of the textile more than 3 inches from the edge of the textile).

The first knit layer 110, in example aspects, is formed from a first plurality of yarns 111. When the first layer comprises a nonwoven textile, the first layer would be formed from a first plurality of fibers. In some examples, the first plurality of yarns 111 (or fibers) may be selected to readily absorb moisture. Stated differently, the first plurality of yarns 111 (or fibers) may be selected to have a relatively high moisture regain such as a moisture regain of about 5% or more, 6% or more, 7% or more, 8% or more, 9% or more, or 10% or more. When the use of natural fibers/yarns is desired, the first plurality of yarns 111 (or fibers) may comprise, for example, cotton, silk, wool, flax, and the like. When synthetic fibers/yarns are desired, the first plurality of yarns 111 (or fibers) may comprise, for example, nylon 6 and/or nylon 66. In some examples, a phase-change material such as a hydrogel or other hygroscopic materials may be added to the first knit layer 110 to further enhance the absorbency characteristics of the first knit layer 110.

FIG. 3 depicts a view of a second surface 310 of the knit spacer textile 100 formed by the second knit layer 112 of the knit spacer textile 100 where the second surface 310 is opposite the first surface 210. A second surface of the textile 150 and/or the textile 170 would have a similar appearance except that the second surface would comprise entangled fibers when the textile is a nonwoven textile or would comprise interwoven yarns when the textile is a woven textile. When incorporated into a garment, the second surface 310 is positioned adjacent a skin surface of a wearer and forms an inner-facing surface, and in some aspects, an innermost-facing surface of the garment. The tie yarns 114 and the first knit layer 110 are further depicted in FIG. 3.

In the example shown in FIG. 3, the second set of apertures 120 is shown as generally circular in shape although other shapes are contemplated herein. Moreover, aspects herein contemplate that the shape of the apertures may differ between the first set of apertures 116 and the second set of apertures 120. For example, the first set of apertures 116 may be circular in shape and the second set of apertures 120 may be ovoid in shape, or vice versa. The number of apertures depicted in FIG. 3, the size of the apertures, the arrangement of the second set of apertures 120, and the spacing between adjacent apertures is illustrative. Aspects herein contemplate one or more of an irregular arrangement of apertures, different spacing between adjacent apertures, different sizes for the apertures, a different number of apertures, and the like. For example, the irregular arrangement, different spacing, different sizes, different number, or other different character of apertures may change from a first zone of the textile to a second zone of the textile. In one aspect, the first zone may comprise an edge region of the textile (e.g., the area of the textile within three inches of the edge of the textile) and the second zone may comprise an interior region of the textile (e.g., an area of the textile more than 3 inches from the edge of the textile). In some examples, the irregular arrangement may continue across the entirety of the textile. In example aspects, there is a one-to-one correspondence in number between the first set of apertures 116 and the second set of apertures 120 such that each aperture in the first set of apertures 116 is axially aligned with a corresponding aperture in the second set of apertures 120.

The second knit layer 112 in example aspects, is formed from a second plurality of yarns 113. When the second layer comprises a nonwoven textile, the nonwoven textile may be formed from a second plurality of fibers. In some examples, the second plurality of yarns 113 (or fibers) may be selected to be relatively more hydrophobic than the first plurality of yarns 111. Stated differently, the second plurality of yarns 113 (or fibers) may be selected to have a moisture regain less than the moisture regain of the first plurality of yarns 111 (or fibers).

An example of a semi-synthetic yarn that may be used for the second plurality of yarns 113 is a cellulose yarn such as viscose or LYOCELL®. In one example, the cellulose yarn may comprise a continuously extruded wetspun cellulose yarn. Using a continuously extruded cellulose yarn such as LYOCELL® versus a staple spun cellulose yarn imparts a smooth surface to the yarn. In turn, the smooth surface provides the second surface 310 with a cooler feel or touch compared to staple spun yarns in which the fiber ends may stick out from the surface and provide a "rougher" feel to the second surface 310. For example, in example aspects, the second knit layer 112 may have a $Q_{MAX}$ of about 0.25 W/cm$^2$ ($Q_{MAX}$ measures the instantaneous heat transfer when the surface of a textile is contacted by a sensor). In other examples, the second knit layer 112 may have a $Q_{MAX}$ of about 0.14 W/cm$^2$ to 0.235 W/cm$^2$. In still other examples, the second knit layer 112 may have a $Q_{MAX}$ of about 0.10 W/cm$^2$ to 0.30 W/cm$^2$. Additionally, the smoothness may provide a low friction surface which improves the handfeel of the textile.

Moreover, using a continuously extruded cellulose yarn versus a staple spun yarn may improve manufacturing efficiencies. For instance, the continuously extruded yarn may be better able to withstand the tension imparted to the yarns during the knitting process thus facilitating the beaming of the yarns and the warp or weft knitting of the yarns. In one example, the second plurality of yarns 113 may have a tenacity of about 4 grams/denier. By contrast, staple spun yarns may break under high tension and may shed more than continuously extruded yarns which decreases manufacturing efficiency.

In examples, cellulose yarns such as viscose or LYOCELL® may be selected because they have a relatively higher moisture regain than, for example, polyester and/or nylon yarns. This may be desirable because the second knit layer 112 may hold some perspiration from the wearer which may help to further cool the air that is entering the apertures 116 and 120 as described further below. In one example, the continuously extruded cellulose yarn may be combined with a yarn having a relatively lower moisture regain to reduce the overall moisture regain of the second plurality of yarns 113. For example, a LYOCELL® yarn may be twisted with a polyester or recycled polyester yarn to reduce the overall moisture regain of the twisted yarn.

When the use of synthetic fibers/yarns is desired, the second plurality of yarns 113 (or fibers) may comprise for example, polyester including recycled polyester, spandex, acrylic, modacrylic, and the like. The use of thermally conductive yarns/fibers is also contemplated herein to help transport heat away from the wearer's skin surface and to impart a "cool" feel to the second surface 310. The cool feel may also be imparted by way of a finish (e.g., a "cool-touch" finish) applied to the second surface 310.

Figure 4:
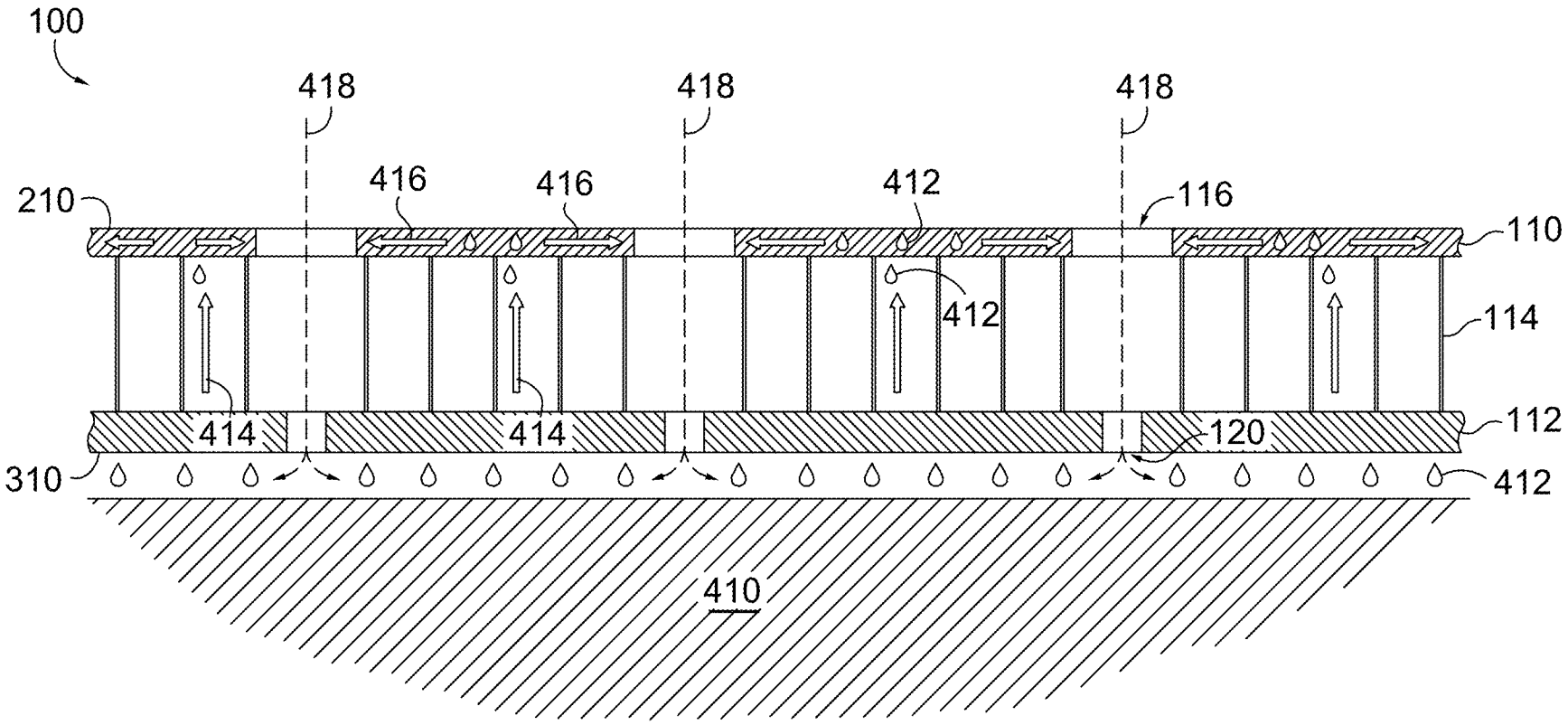
FIG. 4 illustrates a schematic of the knit spacer textile of FIG. 1A positioned adjacent a skin surface of a wearer in accordance with aspects herein.

FIG. 4 depicts a schematic of the knit spacer textile 100 as positioned with respect to a body surface 410 of a wearer. Although the knit spacer textile 100 is shown, the following description is also generally applicable to the textile 150 with exceptions noted herein. A description of how the textile 170 works will be described below. As shown, the second surface 310 of the second knit layer 112 is positioned directly adjacent to the body surface 410. The first knit layer 110 is spaced apart from the second knit layer 112 by the plurality of tie yarns 114 such that the first knit layer 110 is not in contact with the body surface 410 of the wearer. With respect to the textile 150, the first layer 152 is spaced apart from the body surface 410 by the second layer 154.

When the wearer's body surface 410 begins to perspire as indicated by reference numeral 412, the perspiration 412 comes into contact with the second knit layer 112 and the second knit layer 112 helps to "pull" the perspiration 412 off of the wearer's body thereby improving wearer comfort. Because the second plurality of yarns 113 that form the second knit layer 112 is relatively hydrophobic (e.g., relative to the moisture wicking tie yarns 114 and/or the first plurality of yarns 111), it pushes the perspiration 412 toward the moisture-wicking tie yarns 114 (or the first plurality of yarns 111). This removal of moisture from the skin surface enhances breathability by allowing perspiration to be transported away from the body while enabling air to circulate along the wearer's skin. In examples where a cellulose yarn, such as a continuously extruded cellulose yarn is used, some perspiration 412 may be retained in the second knit layer 112. As described below, this may enhance the cooling effect that occurs when air from the environment enters the apertures 116 and 120.

In aspects where the second knit layer 112 is a non-absorbent hydrophobic layer such that it does not absorb the perspiration 412 (e.g., where the moisture uptake is either prevented or significantly inhibited), the moisture-wicking tie yarns 114 that are interlooped with the second knit layer 112 may transport the perspiration 412 to the first knit layer 110.

The moisture-wicking tie yarns 114 transport the perspiration 412 to the first knit layer 110 as indicated by arrows 414. Because the first knit layer 110 is relatively more hydrophilic than the second knit layer 112, it helps to pull the perspiration 412 from the second knit layer 112 and from the tie yarns 114.

Once the perspiration 412 reaches the first knit layer 110, it is absorbed by the first plurality of yarns 111 (or fibers). The absorbed perspiration 412 may spread laterally along the first knit layer 110 as indicated by arrows 416. The retained perspiration 412 in the first knit layer 110 may help to cool the wearer by way of evaporative cooling. This may be especially beneficial when the ambient air is hotter than the wearer's body temperature. In this example, air that enters the knit spacer textile 100 by way of, for example, the apertures 116 and 120, may transfer heat to the perspiration 412 causing the perspiration to change from a liquid to a vapor. The transfer of heat helps to cool the air. The evaporation of the perspiration 412 helps to cool the knit spacer textile 100. The result is that the air that is passing through the knit spacer textile 100 may be at a lower temperature than the ambient air external to the knit spacer textile 100 thus helping to cool the wearer through enhanced evaporative cooling.

Additional cooling is provided by the first and second sets of apertures 116 and 120. As shown by arrows 418, air from the external environment enters the first set of apertures 116. In some examples, the first and second sets of apertures 116 and 120 may be located on a garment such that air from the external environment enters the apertures 116 and 120 generally perpendicular to, for example, the first surface 210 of the knit spacer textile 100. This, in turn, may increase the pressure at which the air enters the knit spacer textile 100 which may contribute to cooling. As the air moves toward the smaller-sized second set of apertures 120, it may speed up as indicated by the smaller dashes in the arrows 418. The relatively fast-moving air exits the second set of apertures 120 and flows over the body surface 410 of the wearer. In particular, a knit spacer textile 100 having enough rigidity such that the textile does not cling to the wearer allows the air entering the second set of apertures 120 to more freely flow of the body surface 410.

When the air is at a lower temperature than the wearer's body surface 410, heat produced by the body surface 410 is carried away from the body surface 410 via the cooler, fast-moving air. For example, when the external air is generally cooler than the wearer's body temperature, a convection current may result with warmer air rising and dissipating through the first and second sets of apertures 116 and 120 and cooler air moving in to take the place of the warmed air. This may further help to cool the wearer by way of convective cooling. Moreover, when cellulose yarns/fibers are used to form the second knit layer 112, the cellulose yarns/fibers may retain some moisture. The air that enters the spacer knit textile 100 by way of the first and second sets of apertures 116 and 120 may promote evaporative cooling from the second knit layer 112 which may further enhance wearer cooling.

With respect to the textile 170 shown in FIG. 1C, the textile 170 may be formed from relatively absorbent yarns or fibers such as cellulose yarns/fibers, wool, alpaca, cotton, and the like. A relatively hydrophobic finish (e.g., finish 176), such as a durable water repellant, may be applied to the second surface 174 to render the second surface 174 relatively more hydrophobic than the first surface 172 of the textile 170. In another example, plasma vapor deposition may be used to impart hydrophobic characteristics to the second surface 174. When the textile 170 is positioned adjacent to a body surface of a wearer (e.g., body surface 410), the perspiration 412 is absorbed from the wearer's body surface 410 into the textile 170. The absorbed perspiration 412 is then pushed due to the hydrophobic gradient toward the relatively more hydrophilic first surface 172 where it evaporates and helps to cool the wearer. The apertures 178 may further help cool the wearer's body surface 410 as described above.

Figure 5:
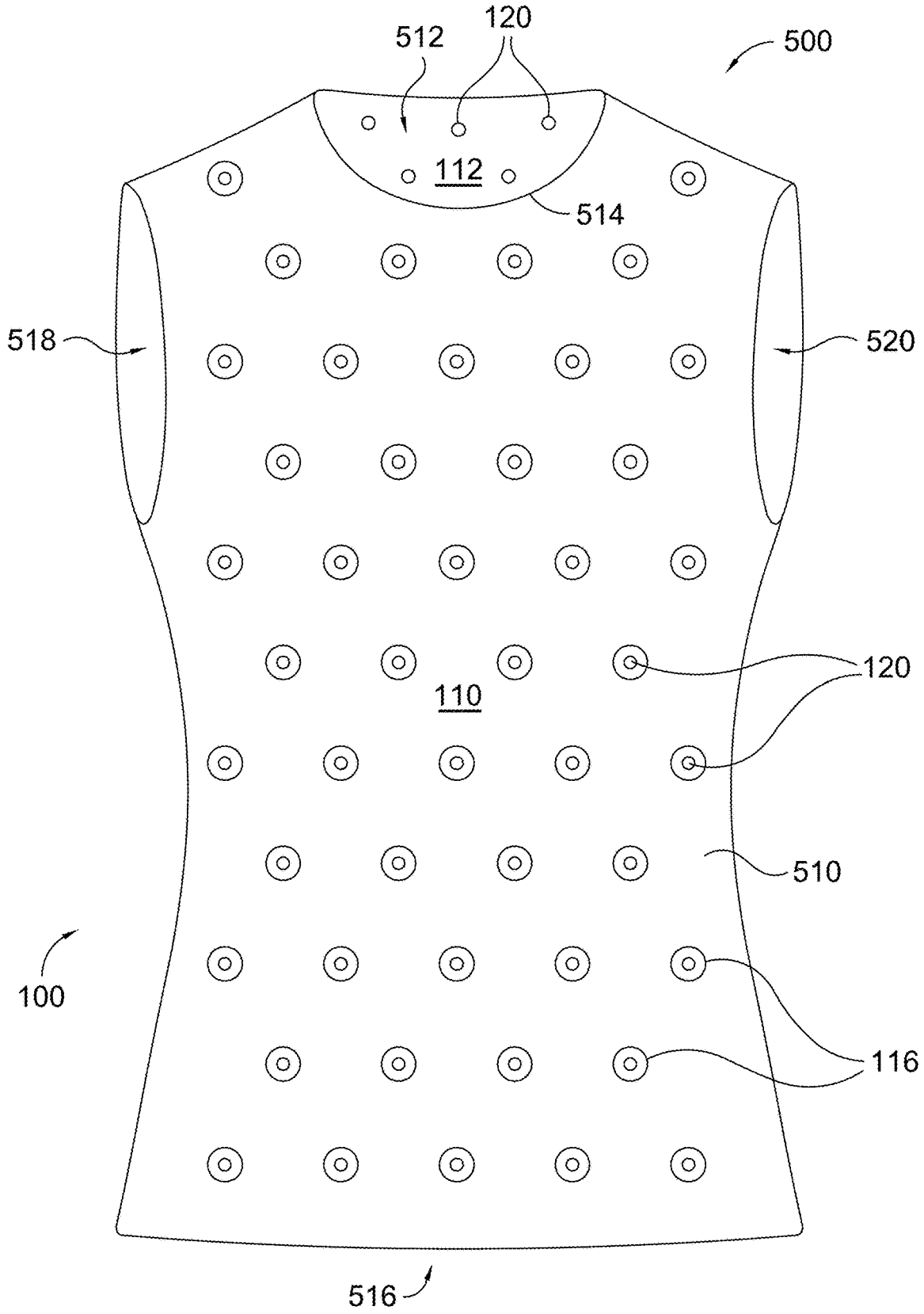
FIG. 5 illustrates an example upper-body garment formed from the textile described herein in accordance with aspects herein.

FIG. 5 illustrates an upper-body garment 500 formed in whole, or in part, from the knit spacer textile 100. In example aspects, the first knit layer 110 is positioned to face outward or externally as shown. Thus, the first knit layer 110 forms an outer-facing surface including an outermost-facing surface of the upper-body garment 500. In example aspects, the second knit layer 112 faces inwardly to form an inner-facing surface including an innermost-facing surface of the upper-body garment 500. When the upper-body garment 500 is formed from the textile 150, the first layer 152 faces outward and the second layer 154 faces inward. When the upper-body garment 500 is formed from the textile 170, the first surface 172 faces outward and the second surface 174 faces inward.

The upper-body garment 500 is depicted as a tank having a front torso portion 510, a back torso portion 512, a neck opening 514, a waist opening 516, a first sleeve opening 518, and an opposite second sleeve opening 520. Although shown as a tank, it is contemplated herein that the upper-body garment 500 may include other configurations such as, for example, a top with sleeves, a jacket, a support garment, a bra, a hoodie, a half-tank, and the like. In example aspects, the upper-body garment 500 may be form-fitting, and in other example aspects, the upper-body garment 500 may be not form-fitting (e.g., loose).

The larger-sized first set of apertures 116 is positioned on the outermost-facing surface of the front torso portion 510, and the smaller-sized second set of apertures 120 is also visible through the first set of apertures 116. The second set of apertures 120 is positioned on the innermost-facing surface of the upper-body garment 500. Aspects herein contemplate that the first and second sets of apertures 116 and 120 may also be present on the back torso portion 512. For example, as depicted near the neck opening 514, the second knit layer 112 is visible as well as the second set of apertures 120. The depiction of the first and second sets of apertures 116 and 120 in FIG. 5 is illustrative, and aspects herein contemplate that the apertures 116 and 120 may have different sizes than that shown, a different configuration than that shown, a different shape than that shown, and the like.

Although the first and second sets of apertures 116 and 120 are depicted as being present throughout the front and back torso portions 510 and 512, aspects herein contemplate that the first and second sets of apertures 116 and 120 may be zonally located based on, for example, heat and/or sweat maps of the human body. For example, the first and second sets of apertures 116 and 120 may be located in areas of high heat and/or sweat-producing parts of the human body (e.g., upper back, upper front).

As described, air passing over the exterior of the upper-body garment 500 may be funneled into the interior of the upper-body garment 500 by way of the first and second sets of apertures 116 and 120. The fast-flowing air may then circulate around the wearer's body helping to cool the wearer. This circulation of air within the garment enhances breathability of the garment. The description regarding the apertures 116 and 120 is also applicable to the apertures 156 and 160 of the textile 150 and the apertures 178 of the textile 170.

Figure 6:
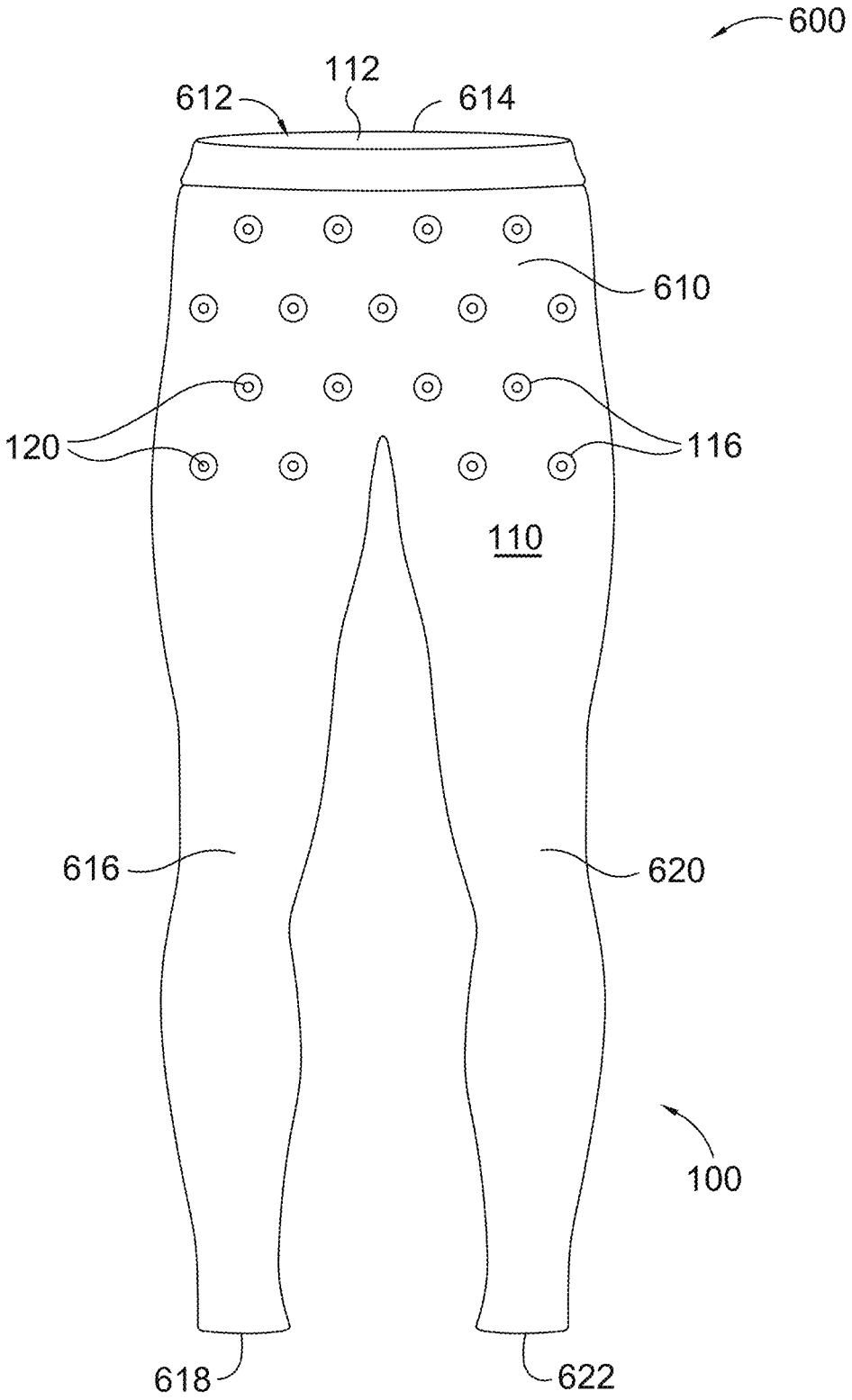
FIG. 6 illustrates an example lower-body garment formed from the textile described herein in accordance with aspects herein.

FIG. 6 illustrates a lower-body garment 600 formed in whole, or in part, from the knit spacer textile 100. In example aspects, the first knit layer 110 is positioned to face outward or externally as shown. Thus, the first knit layer 110 forms an outer-facing surface including an outermost-facing surface of the lower-body garment 600. In example aspects, the second knit layer 112 faces inwardly and forms an inner-facing surface including an innermost-facing surface of the lower-body garment 600. When the lower-body garment 600 is formed from the textile 150, the first layer 152 faces outward and the second layer 154 faces inward. When the lower-body garment 600 is formed from the textile 170, the first surface 172 faces outward and the second surface 174 faces inward.

The lower-body garment 600 is depicted as a legging having a front torso portion 610, a back torso portion 612, a waist opening 614, a first leg portion 616 having a first leg opening 618, and a second leg portion 620 having a second leg opening 622. Although shown as a legging, it is contemplated herein that the lower-body garment 600 may include other configurations such as, for example, a three-quarter tight, a half-tight, a short, a pant, a shant, a singlet, a unitard, and the like. Aspects herein contemplate that the lower-body garment 600 may be form-fitting or loose.

The larger-sized first set of apertures 116 is positioned on the outermost-facing surface of the front torso portion 610, and the smaller-sized second set of apertures 120 is also visible. The second set of apertures 120 is positioned on the innermost-facing surface of the lower-body garment 600. Aspects herein contemplate that the first and second sets of apertures 116 and 120 may also be present on the back torso portion 612. The depiction of the first and second sets of apertures 116 and 120 in FIG. 6 is illustrative, and aspects herein contemplate that the apertures 116 and 120 may have different sizes than that shown, a different configuration than that shown, and the like. The first and second sets of apertures 116 and 120 in FIG. 6 are depicted as being zonally located based on, for example, heat and/or sweat maps of the human body. Aspects herein also contemplate that the first and second sets of apertures 116 and 120 may be present throughout the front and back torso portions 610 and 612 and the first and second leg portions 616 and 620. The description regarding the apertures 116 and 120 is also applicable to the apertures 156 and 160 of the textile 150 and the apertures 178 of the textile 170.

As described, air passing over the exterior of the lower-body garment 600 may be funneled into the interior of the lower-body garment 600 by way of the first and second sets of apertures 116 and 120. The fast-flowing air may then circulate around the wearer's body helping to cool the wearer. This circulation of air within the garment enhances breathability of the garment. The description regarding the apertures 116 and 120 is also applicable to the apertures 156 and 160 of the textile 150 and the apertures 178 of the textile 170.

In another embodiment, a garment may include a first set of aperture structures in one zone and a second set of aperture structures in another zone. The first set of aperture structures may have one or more properties that are different from the second the second set of aperture structures. In one example, the first set of aperture structures may have a different size compared to the second set of aperture structures, and as such air flow properties (e.g., air flow velocity) through the first set of aperture structures may be different from the air flow properties through the second set of aperture structure, which may allow for different cooling effects at different portions of the garment. The first set of aperture structures may each include a first aperture and a second aperture, such as the aperture **116*a* in the first knit layer 110 and the second aperture 120*a* in the second knit layer 112 all in the textile 100 as shown in FIG. 1**A. Likewise, the second set of aperture structures may each include a first aperture and a second aperture. While the above example describes two zones, in some examples, the garment may comprise more than two zones, each having different aperture structures.

In one example, the different zones in the garment may be integrally formed. For example, a first zone having the first set of aperture structures and a second zone having a second set of aperture structures may include a common yarn extending across the first and the second zones on at least a first face of the garment.

In another example, the different zones may be formed by coupling different textiles together. For example, the first zone may be formed with a first textile having a first set of aperture structures and the second zone may be formed with a second textile having a second set of aperture structures.

Figure 7:
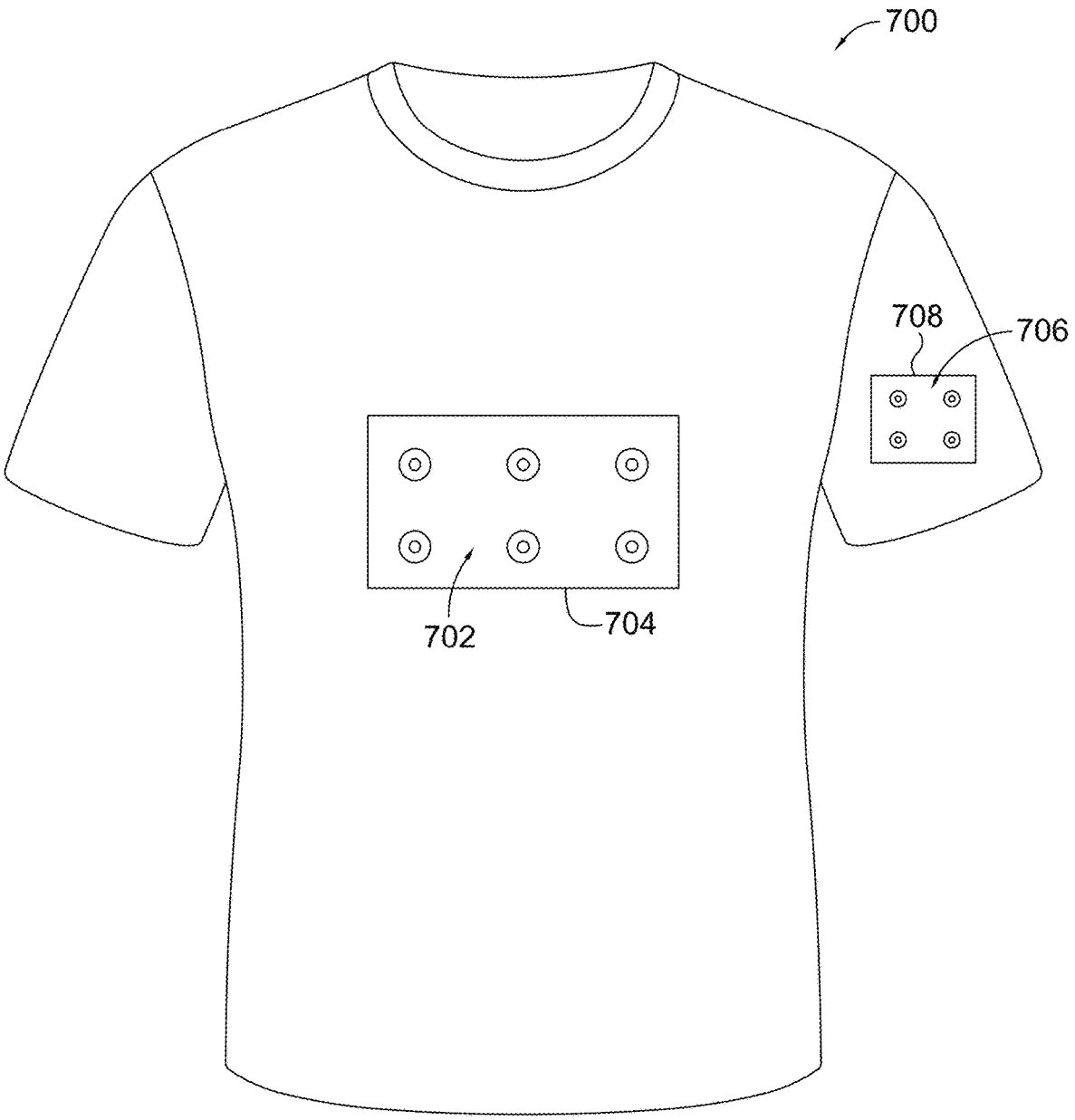
FIG. 7 illustrates an example upper-body garment formed from the textile described herein in accordance with aspects herein.

Turning to FIG. 7, an upper-body garment 700 is depicted as a shirt. In aspects, the upper-body garment 700 may be donned over an underlayer (e.g., a bra) that is worn for modesty, support, or other purposes. The underlayer may only be associated with a portion of the upper-body garment 700 (e.g., a chest region, etc.). Aspects herein contemplate first and second sets of apertures (e.g., 702 and 706) being zonally located based on, for example, regions of the upper-body garment 700 associated with where an underlayer would be worn when the upper-body garment 700 is donned.

For example, the upper-body garment 700 may include a first set of aperture structures 702 and a second set of aperture structures 706. The first set of aperture structures 702 may be positioned in a first zone 704 of the upper-body garment 700 and the second set of aperture structures 706 may be positioned in a second zone 708 of the upper-body garment 700. As illustrated, the first zone 704 is located in a chest region of the upper-body garment 700 and the second zone 708 is located in a sleeve region of the upper-body garment 700.

Each of the first zone 704 and the second zone 708 may be comprised of a textile such as textile 100, 150 or 170. For sake of brevity, the structure of such textiles will not be repeated here, but each such textile may be used in the upper-body garment 700.

Although shown as spaced apart, the first zone 704 and the second zone 708 may be positioned adjacent one another. Likewise, while depicted as two discrete zones of the upper-body garment 700, in some aspects either the first zone 704 or the second zone 708 may comprise the entirety of the upper-body garment 700 except for the portion comprising the other zone. In still further aspects, the upper-body garment 700 may include additional textiles to complete the garment outside of the first zone 704 and the second zone 708. In addition, the upper-body garment 700 may include a plurality of first zones 704 and/or a plurality of second zones 708.

The first set of aperture structures 702 may be larger than the second set of aperture structures 706, in aspects. Having larger apertures can improve cooling when an underlayer is worn. In aspects, the first set of aperture structures 702 each include a first aperture through a first layer and a second aperture through a second layer. Similarly, the second set of aperture structures 706 each include a third aperture through the first layer and a fourth aperture through the second layer. In aspects, the first aperture is larger than the third aperture and the second aperture is larger than the fourth aperture.

In another embodiment, a garment may comprise a first textile in one zone and a second textile in another zone. The first textile may have one or more properties or structures that are different from the second textile. In one example, the first textile may comprise a knit textile, a woven textile, a non-woven textile, or a double-knit textile while the second textile may comprise one of the textile 100, the textile 150, or the textile 170. While the above example describes two zones, in some examples, the garment may comprise more than two zones, each having different textiles.

In one example, the different zones in the garment may be integrally formed. For example, a first zone having the first textile and a second zone having the second textile may include a common yarn extending across the first and the second zones on at least a first face of the garment.

In another example, the different zones may be formed by coupling different textiles together. For example, the first zone may be formed with a first textile and the second zone may be formed with a second textile.

Figure 8:
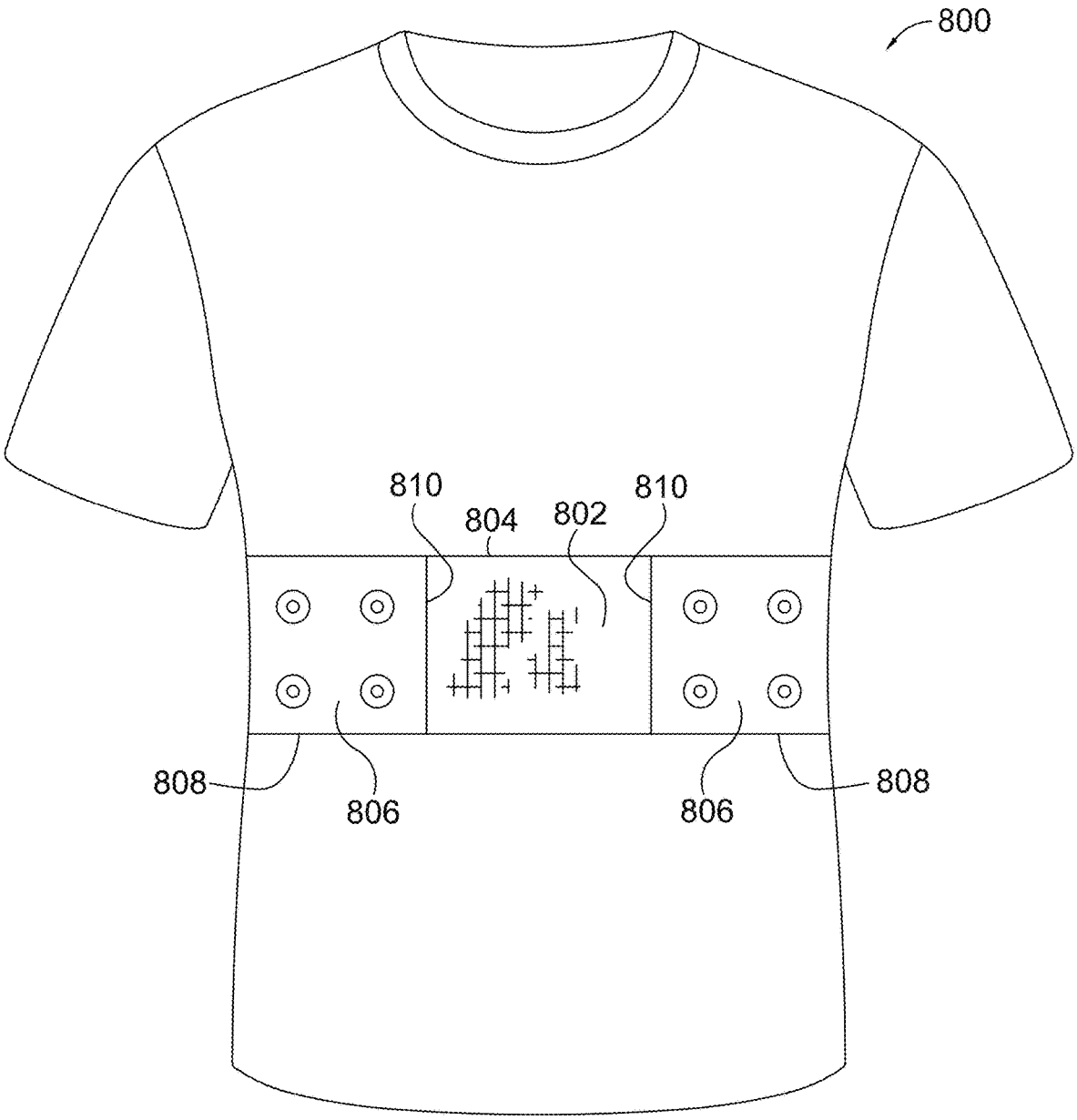
FIG. 8 illustrates an example upper-body garment formed in part from the textile described herein and in part from another textile in accordance with aspects herein.

FIG. 8 illustrates an upper-body garment 800. The upper-body garment 800 is depicted as a shirt. In aspects, the upper-body garment 800 may be comprised of two or more textiles. Aspects herein contemplate a first textile 802 and a second textile 806 being zonally located based on, for example, heat and/or sweat maps of the human body. For example, a first textile 802 may be present in a first zone 804 and a second textile 806 may be present in a second zone 808, where the first zone 804 is associated with a lower sweat region of the human body and the second zone 808 is associated with a higher sweat region of the human body.

The first textile 802 may comprise a textile that includes hydrophobic characteristics, such as the hydrophobic characteristics discussed above. In aspects, the first textile 802 may be a knit textile, a double knit textile, a non-woven textile, or a woven textile. In aspects, the first textile 802 may include a durable water repellant finish applied to one surface. The hydrophobic characteristics of the first textile 802 may encourage perspiration from a wearer to move towards a less hydrophobic portion of the upper-body garment 800 (e.g., second zone 808).

The second textile 806 may comprise any of textiles 100, 150 or 170. For sake of brevity, the structure of such textiles will not be repeated here, but each such textile may be used in the upper-body garment 800. In aspects, the second layer (e.g., 112, 154, 176) of the second textile 806 may be less hydrophobic (or, said another way, more hydrophilic) than the first textile 802. In this way, perspiration may be taken up more readily by the second textile 806 than the first textile 802.

In aspects, the upper-body garment 800 may include one or more first zones 804 and one or more second zones 808. For example, the aspect depicted includes one first zone 804 flanked by a second zone 808 on either lateral side thereof.

In aspects, the first zone 804 may be positioned adjacent to the second zone 808. For example, the first textile 802 may be joined to the second textile 806. In aspects, the first textile 802 is joined to the second textile 806 at a seam 810. The seam 810 may be formed by stitching, bonding, welding (e.g., ultrasonic welding), fusing, or other joining process. In aspects, an edge of the first textile 802 and an edge of the second textile 806 may be turned out away from an interior of the garment being constructed to form the seam 810, which may enhance wearer comfort at the seam 810.

Figure 9:
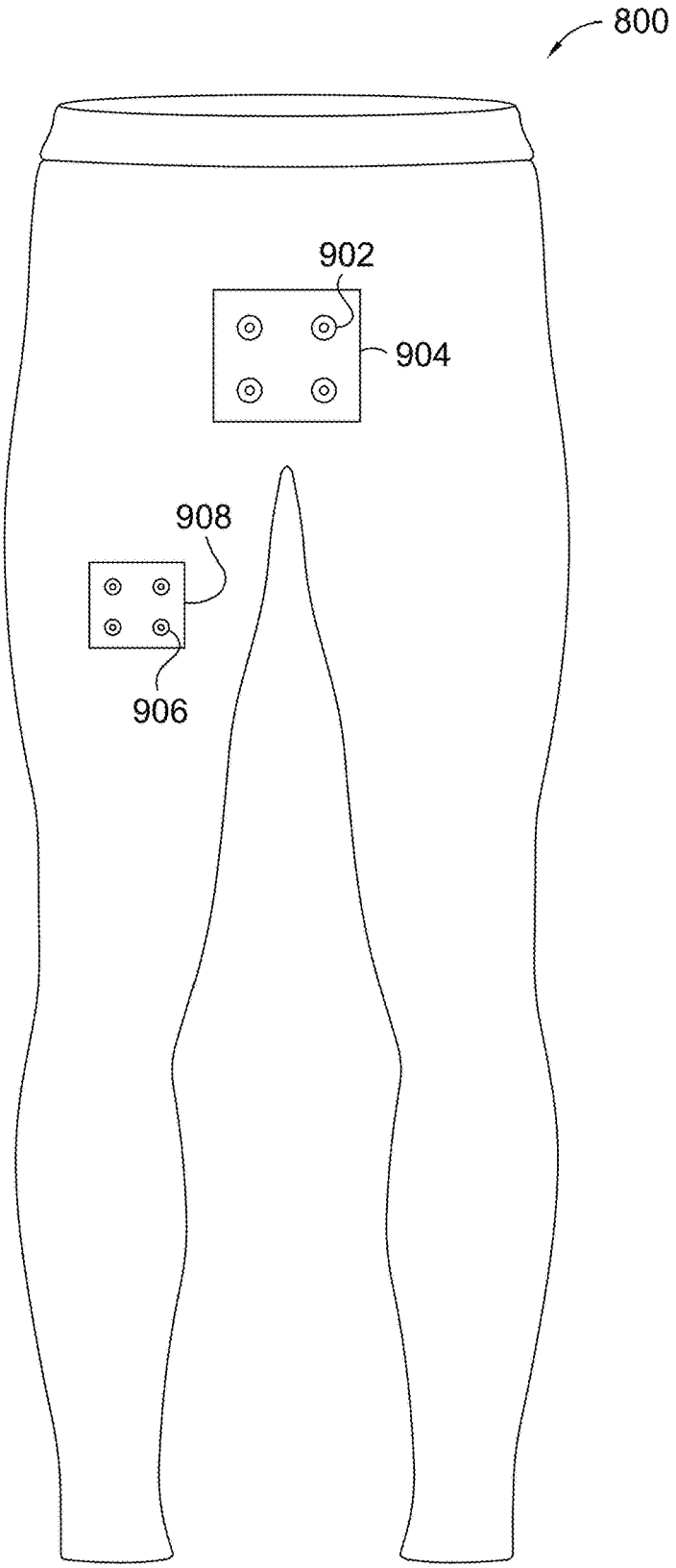
FIG. 9 illustrates an example lower-body garment formed from the textile described herein in accordance with aspects herein.

Referring to FIG. 9, a lower-body garment 900 is shown. The lower-body garment 900 may comprise a pant, a short, a skirt, and the like. Thus, it is contemplated that the lower body garment 900 may include a first set of aperture structures 902 and a second set of aperture structures 906 that are zonally located based on, for example, regions of the lower-body garment 900 where an underlayer would be worn when the lower-body garment 900 is donned. Thus, the first set of aperture structures 902 are positioned in a first zone 904 and the second set of aperture structures 906 are positioned in a second zone 908. Otherwise, the lower-body garment 900 is similar to the upper-body garment 700 and each of the variations discussed in reference to the upper-body garment 700 need not be repeated here.

Figure 10:
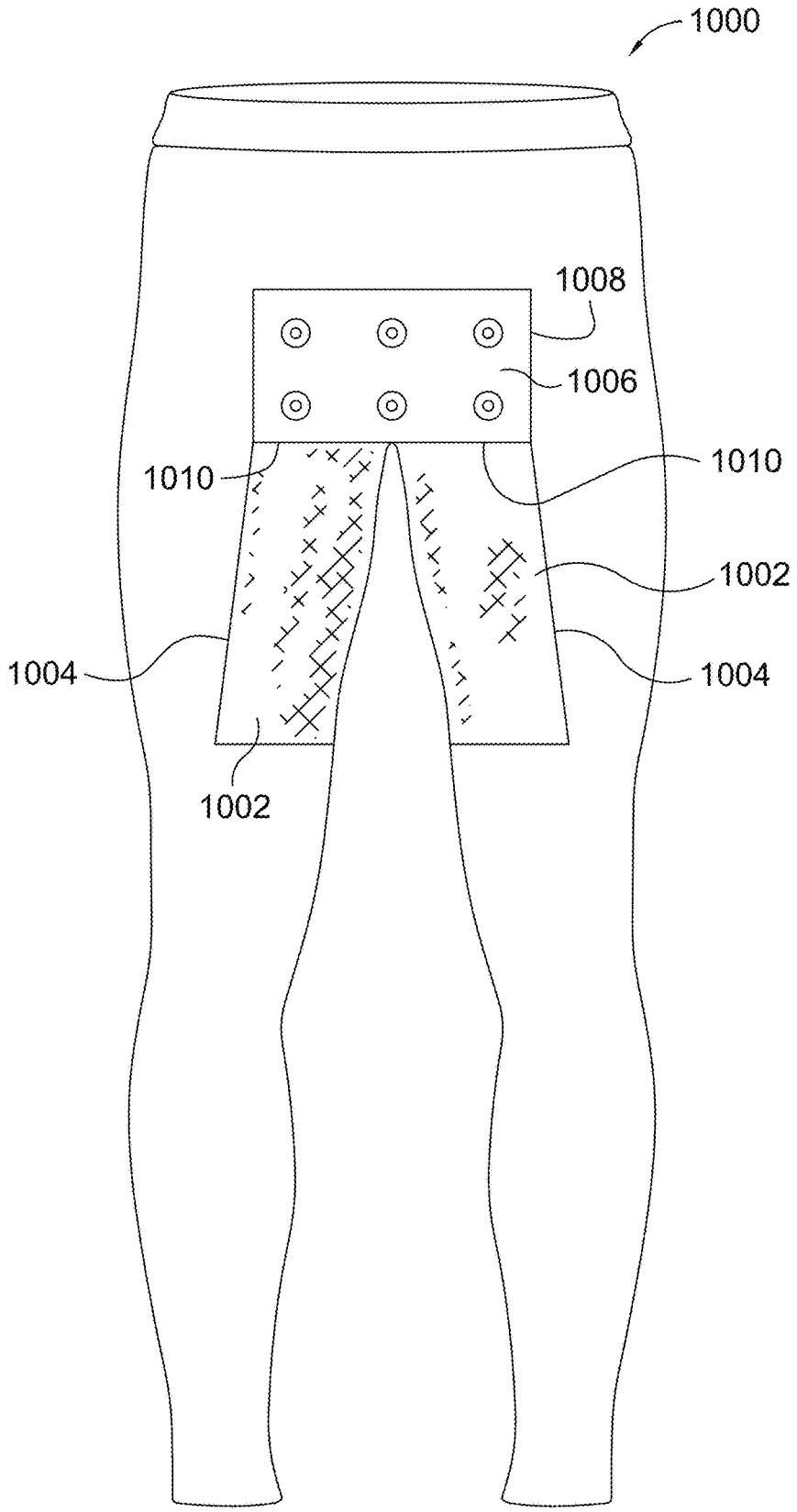
FIG. 10 illustrates an example lower-body garment formed in part from the textile described herein and in part from another textile in accordance with aspects herein.

Referring to FIG. 10, a lower-body garment 1000 is shown. The lower-body garment 1000 may comprise a pant, a short, a skirt, and the like. In aspects, the lower-body garment 1000 may be comprised of two or more textiles, for example a first textile 1002 and a second textile 1006. It is contemplated that the first textile 1002 and the second textile 1006 are zonally located based on, for example, heat and/or sweat maps of the human body. Thus, the first textile 1002 may be located in a first zone 1004 and the second textile 1006 may be located in a second zone 1008. The first zone 1004 is shown positioned along an in-seam of the lower-body garment 1000 while a second zone 1008 is shown positioned at a pelvic region of the lower-body garment 1000. In aspects, the first zone 1004 is adjacent the second zone 1008 such that the first textile 1002 is joined to the second textile 1006 at a seam 1010. Otherwise, the lower-body garment 1000 is similar to the upper-body garment 800 and each of the variations discussed in reference to the upper-body garment 800 need not be repeated here.

Figure 11:
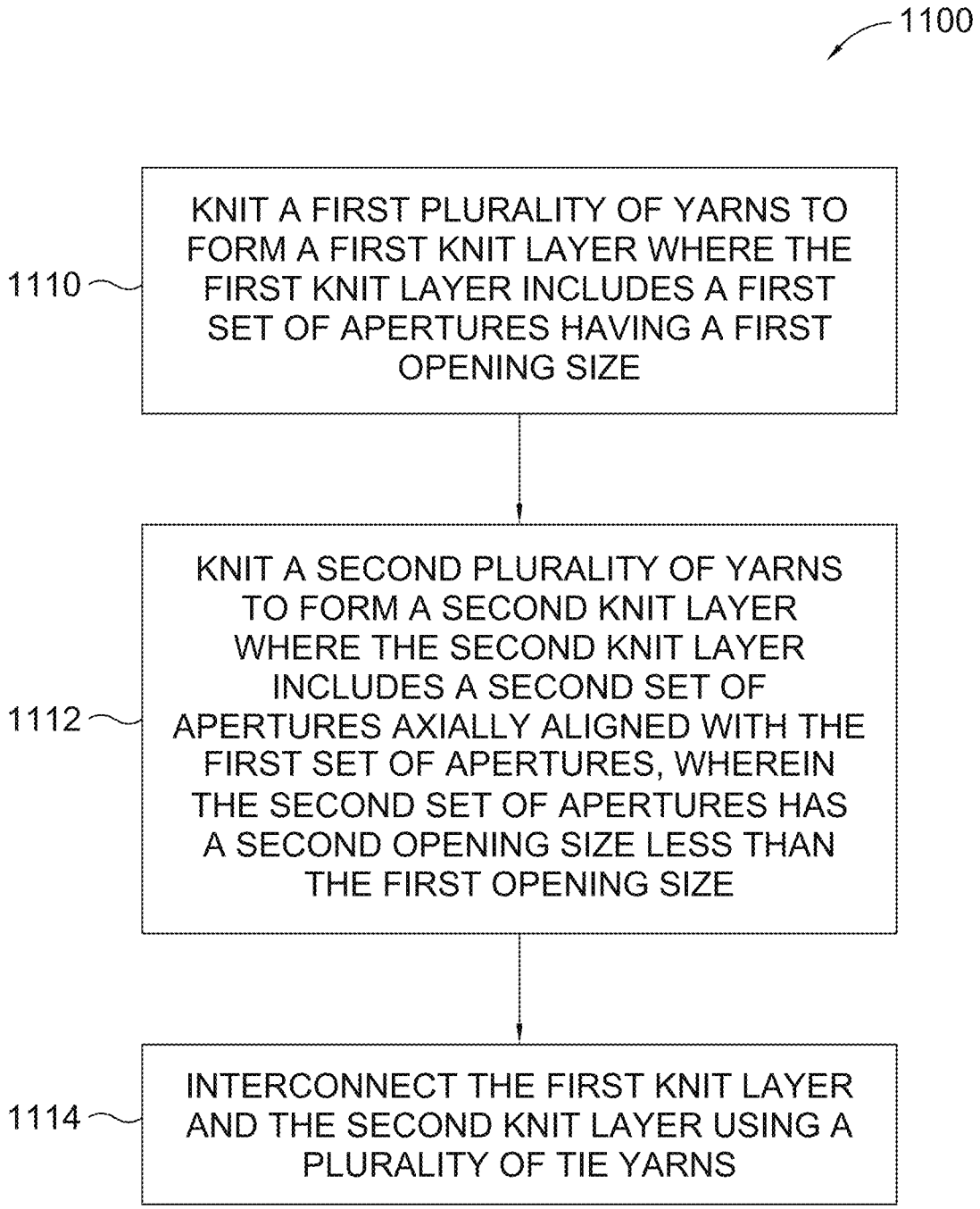
FIG. 11 illustrates a flow diagram of an example method of manufacturing the knit spacer textile of FIG. 1A in accordance with aspects herein.

FIG. 11 depicts a flow diagram of an example method 1100 of manufacturing a knit spacer textile such as the knit spacer textile 100. At a step 1110, a first plurality of yarns, such as the first plurality of yarns 111, is knitted to form a first knit layer such as the first knit layer 110. Knitting the first knit layer further includes knitting in a first set of apertures, such as the first set of apertures 116 where each aperture in the first set of apertures has a first opening size. The first set of apertures may be knitted using, for example, a loop transfer knit process. In examples, the first plurality of yarns may be selected to be relatively hydrophilic such that the yarns absorb moisture in the form of, for example, perspiration. The first plurality of yarns may include natural yarns, semi-synthetic yarns, and/or synthetic yarns including recycled yarns.

At a step 1112, a second plurality of yarns, such as the second plurality of yarns 113, is knitted to form a second knit layer such as the second knit layer 112. Knitting the second knit layer further includes knitting in a second set of apertures, such as the second set of apertures 120. The second set of apertures may be knitted using, for example, a loop transfer stitch process. Each apertures in the second set of apertures is axially aligned with an aperture in the first set of apertures. Further, each aperture in the second set of apertures has a second opening size that is less than the first opening size. In examples, the second plurality of yarns may be selected to be relatively more hydrophobic than the first plurality of yarns such that the second plurality of yarns may "push" moisture in the form of perspiration toward the first knit layer. The second plurality of yarns may include natural, semi-synthetic, and/or synthetic yarns including recycled yarns.

At a step 1114, the first knit layer is interconnected with the second knit layer using a plurality of tie yarns such as the plurality of tie yarns 114. The tie yarns may be selected to be moisture-wicking and may include natural, semi-synthetic, and/or synthetic yarns including recycled yarns.

The method 1100 may further include one or more post knitting treatments. For example, after knitting steps 1110, 1112, and 1114 discussed above, the knit spacer textile may be heat set into a desired configuration, shape, or position. The heat setting may hold the first set of apertures and/or the second set of apertures in a desired position, shape, or configuration.

Another example of a post knitting treatment includes, after knitting steps 1110, 1112, and 1114 discussed above, the knit spacer textile may be stretched into a desired configuration, shape, or position. Stretching may open the first set of apertures or the second set of apertures to a desired size, shape, or position.

Another example of a post knitting treatment includes, after knitting steps 1110, 1112, and 1114 discussed above, the knit spacer textile having a coating applied to one or more surfaces of the first knit layer and the second knit layer of the knit spacer textile. The coating may provide increased or decreased hydrophilic or hydrophobic characteristics to the treated surface, which may promote the moisture wicking described above.

Yet another example of a post knitting treatment includes, after knitting steps 1110, 1112, and 1114 discussed above, the knit spacer textile may be molded (with or without the application of heat and/or pressure) to create a pattern, indentation, raised structure, or other surface feature on one or more surfaces of the first knit layer and the second knit layer of the knit spacer textile. The pattern may provide aesthetic characteristics to the treated surface. The indentation, particularly when on the inner surface of the knit spacer textile, may reduce contact between a wearer's skin surface and the knit spacer textile resulting in reduced cling. The raised structure, particularly when on the inner surface of the knit spacer textile, may create stand-off between the knit spacer textile and the wearer's skin surface to promote airflow therebetween and also to reduce cling.

Still another example of a post knitting treatment includes, after knitting steps 1110, 1112, and 1114 discussed above, sublimation printing on the knit spacer textile. Sublimation printing on the knit spacer textile may enhance the aesthetic quality of the textile by incorporating color or a design aspect on one or more surfaces (e.g., the outer surface) of the knit spacer textile.

Although described as separate post knitting treatments, in some aspects after knitting steps 1110, 1112, and 1114 discussed above two or more of the post knitting treatments may be applied to the knit spacer textile. Any combination of the above described post knitting treatments is contemplated.

The method 1100 may further include forming the knit spacer textile into a garment such as the upper-body garment 500 and/or the lower-body garment 600. When incorporated into a garment, the first knit layer forms an outer- or outermost-facing surface of the garment, and the second knit layer forms an inner- or innermost-facing surface of the garment.

Other aspects of an upper body garment constructed from a knit spacer textile will now be described in reference to FIGS. 12-15. As discussed herein, the stiffness of yarns of a textile determine how much the textile drapes when donned by a wearer. Also as discussed herein, stiffer yarns may help airflow through the textile. Using stiffer yarns to form textiles that drape less, however, may result in other less desirable effects. For example, stiff fabrics tend to bunch at the crook of the elbow due to bending and flexing of the arm. In another example, stiff fabrics tend to resist bending and conforming to body movements. When an arm is raised, the garment may not flow or stretch to accommodate the movement, causing the entire garment to lift instead of allowing localized stretching. Thus, using stiffer yarns can cause undesirable bunching or pulling of the textile, which may cause discomfort to the wearer or non-aesthetic presentation on the wearer.

One way to address undesired bunching is to remove portions of the garment where compression forces act (e.g., at the crook of the elbow when bending the elbow). For example, a portion of the textile may be removed so that only a reduced amount of compressive forces are experienced by the garment proximate the wearer's crook of the elbow. In another example, the portion of the textile removed may be large enough such that all of the compressive forces that would otherwise be experienced by the garment proximate the wearer's elbow are eliminated.

Similarly, one way to address undesired lifting is to remove portions of the garment through which tension is transferred. For example, a portion of the textile may be removed so that tension is not transmitted from an arm portion to a torso portion of the garment when the wearer raises their arm.

In some examples, voids are formed in the textile in strategic locations. The voids may be cut out from the textile in some aspects. In other aspects, the garment is formed with the voids integrated therein. Additionally, a secondary textile may be incorporated into the void. For example, a gusset structure may be formed. In some aspects, the secondary textile may be joined to the textile to form the completed garment.

Figure 12:
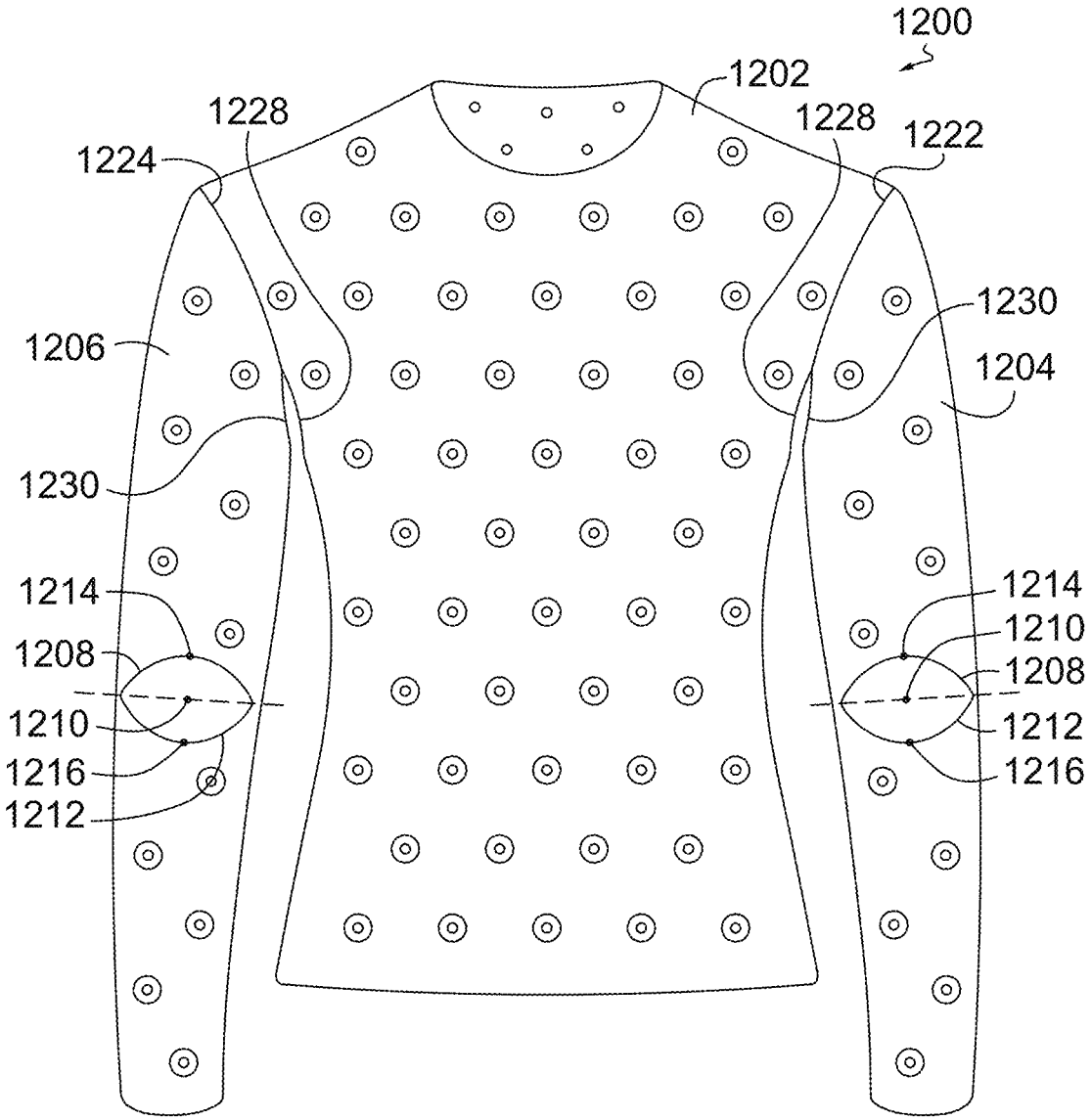
FIG. 12 illustrates an example upper-body garment formed from the textile described herein and including one or more stress-reducing zones in accordance with aspects herein.

Turning now to FIG. 12, an upper-body garment 1200 is depicted. The upper-body garment 1200 includes a torso portion 1202, a left arm portion 1204 extending from the torso portion 1202, and a right arm portion 1206 extending from the torso portion 1202. The upper-body garment 1200 may be comprised of any of the textiles described herein (e.g., the knit spacer textile, a double-knit textile, non-woven textile, etc.). The upper-body garment 1200 may be comprised of any of the yarns described herein having any of the stiffnesses described herein.

In order to reduce or eliminate bunching around the elbow, the left arm portion 1204 and the right arm portion 1206 may each include a stress-reducing zone 1208. Each stress-reducing zone 1208 may comprise an opening in the left arm portion 1204 and the right arm portion 1206. The openings may be integrally formed in the upper-body garment 1200, according to some aspects. In other aspects, the openings may be cut-out of the upper-body garment 1200. The openings may comprise vent zones, in some examples.

As used in reference to FIGS. 12-15, the term "openings" references the stress reducing zones or vent zones that are orders of magnitude larger than the small interstitial spaces typically formed between loops in conventional knit structures. Likewise, in reference to FIGS. 12-15, the "openings" are orders of magnitude larger than the opening size of the first set of apertures or the second set of apertures. For example, the openings in FIGS. 12-15 may be at least three times larger than the opening size of the first set of apertures.

The stress-reducing zones 1208 are positioned at an area of the left arm portion 1204 and the right arm portion 1206 associated with the crooks of a wearer's left elbow and right elbow. For example, the stress-reducing zones 1208 may have a center line 1210 that extends in the lateral to medial direction and bisects the stress-reducing zones 1208. In aspects, the centerline 1210 may be aligned with a wearer's elbow crease when the upper-body garment 1200 is donned. The stress-reducing zones 1208 may include a perimeter 1212, a proximalmost point 1214, and a distalmost point 1216. In aspects, the proximalmost point 1214 is offset proximally up the arm portions and the distalmost portion 1216 is offset distally down the arm portions between 0.5 inches and 3 inches from the centerline 1210.

In some aspects, the stress-reducing zones 1208 have an elliptical shape. In other aspects, the stress-reducing zones 1208 have a circular shape. In still other aspects, the stress-reducing zones 1208 have a different regular or irregular shape.

Having an opening at the stress-reducing zones 1208 reduces or eliminates the compression forces present in the garment 1200 when a wearer bends or flexes their arm at the elbow joint, which in turn reduces or eliminates the bunching that might otherwise occur in such region.

Figure 13:
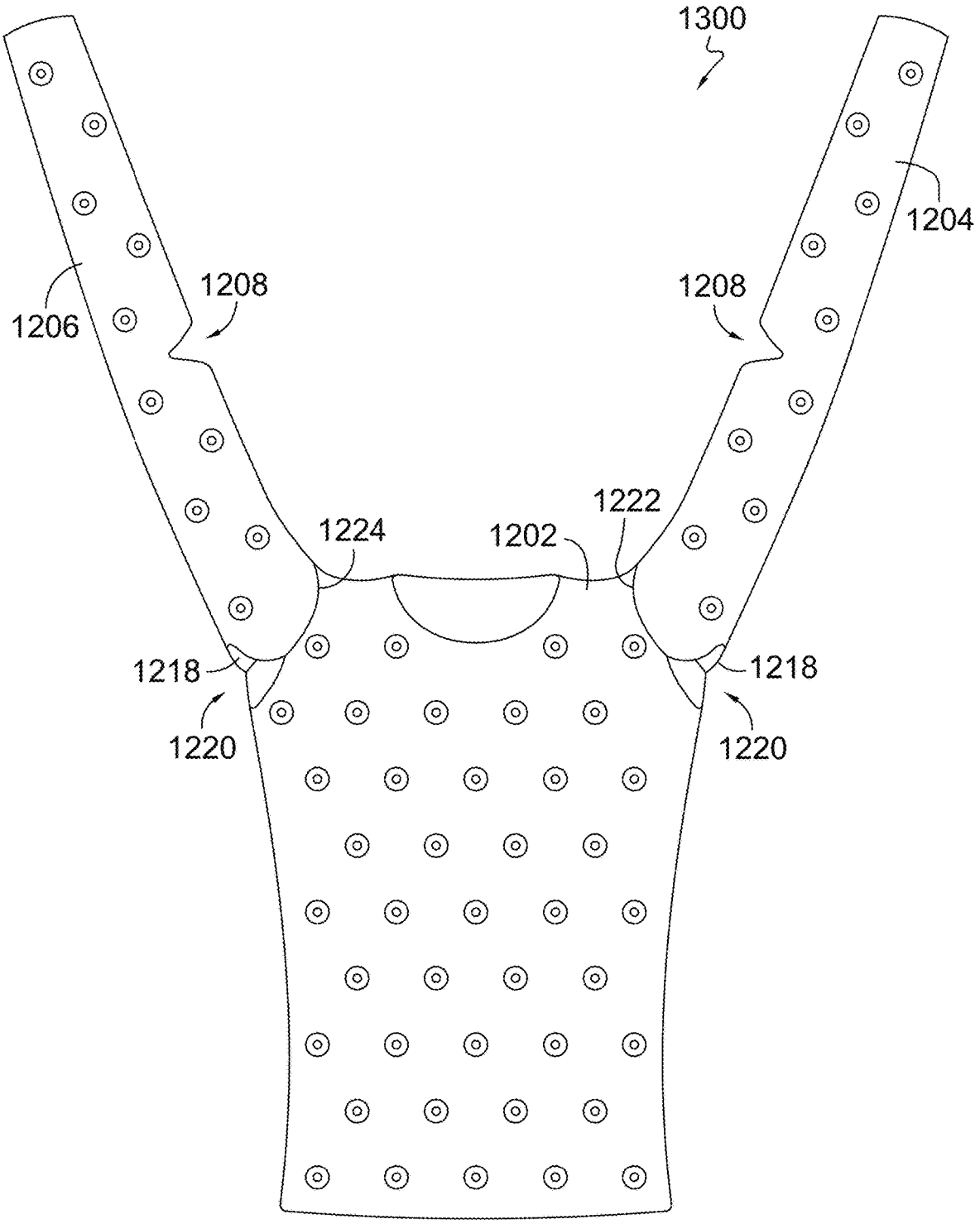
FIG. 13 illustrates the upper-body garment of FIG. 12 with the arms raised in accordance with aspects herein.
Figure 14:
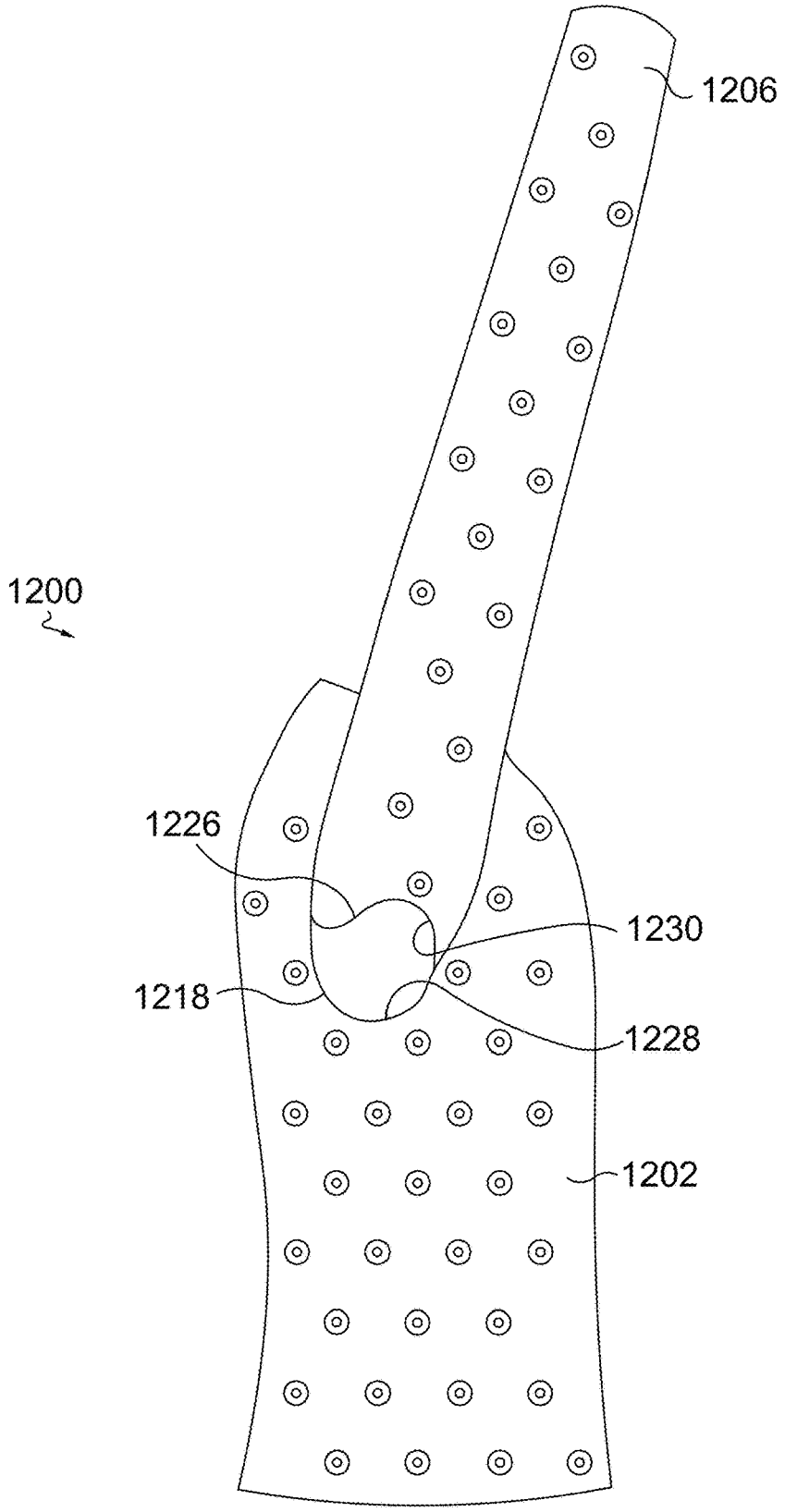
FIG. 14 illustrates a side view of the upper-body garment of FIG. 12 in accordance with aspects herein.

Referring to FIGS. 13 and 14, the upper-body garment 1200 is depicted having the left arm portion 1204 and the right arm portion 1206 raised relative to the torso portion 1202. The upper-body garment 1200 in this view shows only a portion of the stress-reducing zones 1208. In addition, the upper-body garment 1200 includes a second set of stress-reducing zones 1218 positioned in an underarm region 1220.

The second set of stress-reducing zones 1218 may also comprise openings formed in the upper-body garment 1200. In some aspects, these openings may be integrally formed in the upper-body garment 1200. In other aspects, these opening may be cut out from the upper-body garment 1200. In still other aspects, these openings may comprise seam openings intentionally left in a left seam 1222 and a right seam 1224. Any combination of the above is contemplated.

Positioning an opening in the underarm region 1220 reduces or eliminates tension that may occur in such region when a wearer raises their arm overhead. Reducing or eliminating such tension may reduce or eliminate displacement (e.g., through pulling) of the torso portion 1202 when the arm is raised overhead. In other words, the torso portion of a garment having the rigidity associated with the yarns discussed herein will not raise because the wearer raises their arm overhead and instead the sleeve hinges upward.

Thus, the left arm portion 1204 and the right arm portion 1206 may be only partially joined to the torso portion 1202 (e.g., at the left seam 1222 and the right seam 1224). The second set of stress-reducing portions 1218 may include a perimeter 1226. The perimeter 1226 may be partially defined by an unattached edge 1228 of the torso portion 1202 and partially defined by an unattached edge 1230 of the respective arm portion (e.g., 1206).

Although depicted has having both a first set of stress-reducing zones 1208 and a second set of stress-reducing zones 1218, other aspects of the upper-body garment 1200 may only include one set or the other.

Figure 15:
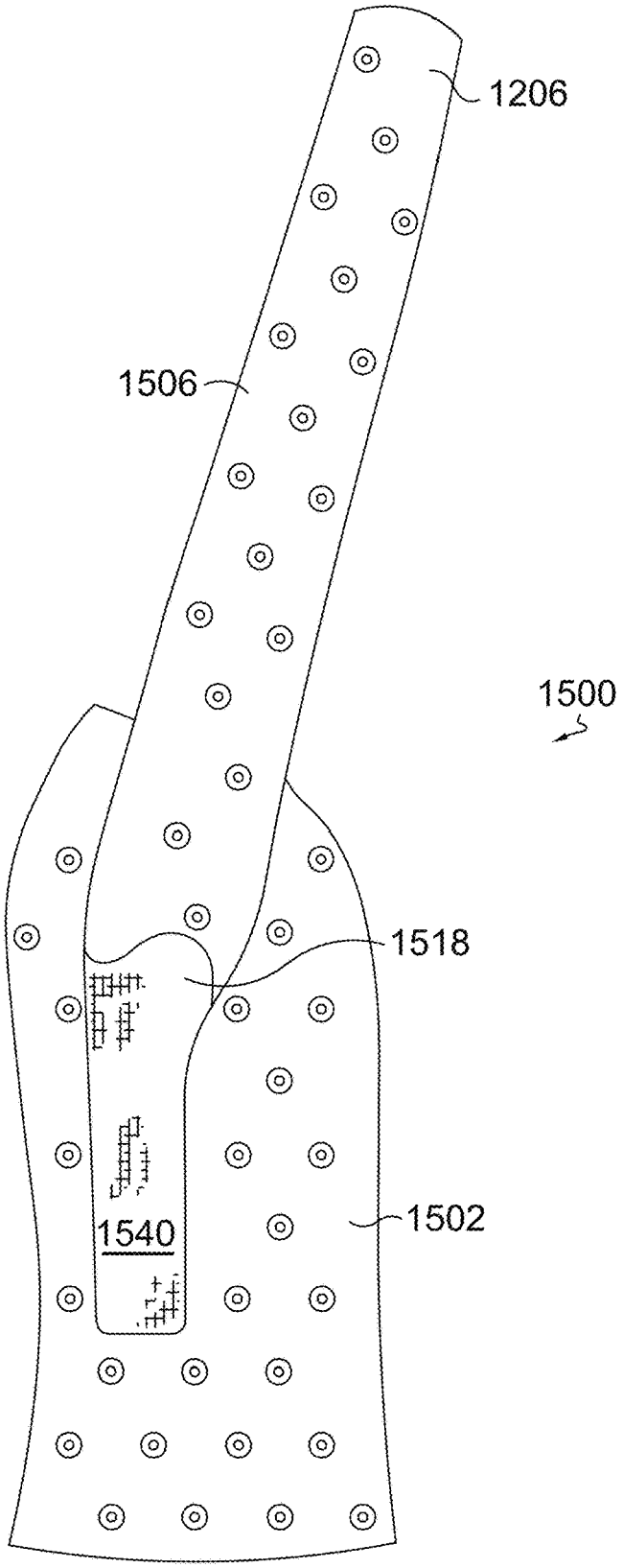
FIG. 15 illustrates another example upper-body garment formed from the textile described herein and including one or more stress-reducing zones where a second textile panel is affixed in the opening of the one or more stress-reducing zones in accordance with aspects herein.

Referring now to FIG. 15, an upper-body garment 1500 is depicted. The upper-body garment 1500 is much the same as the upper-body garment 1200, except as noted below. The upper-body garment 1500 includes a torso portion 1502, a left arm portion (not pictured), and a right arm portion 1506. In FIG. 15, the right am portion 1506 is raised relative to the torso portion 1502. The upper-body garment 1500 also includes a second set of stress-reducing zones 1518. Unlike the stress-reducing zones 1218, however, the stress-reducing zones 1518 are filled in with a second textile 1540 and are larger in size. The second textile 1540 may be joined to a perimeter 1526 of the stress-reducing zones 1518. The second textile 1540 may have lower stiffness than that of the textile comprising the remainder of the upper-body garment 1500 (e.g., the knit spacer textile, the double knit textile, the non-woven textile, etc.). The second textile 1540 having a lower relative stiffness may still provide reduced or eliminated displacement (e.g., pulling) of the torso portion 1502 when the arm is raised overhead, yet also provide enhanced modesty to the upper-body garment 1500.

Although not depicted, the upper-body garment 1500 may also include the stress-reducing zones proximate a crook of the elbow region of the respective arm portions. These stress-reducing zones may also include a panel of the second textile to fill in the opening in the arm portion. It is further contemplated, that some aspects may include the second textile in one set of stress-reducing zones (e.g., 1208) but not in the other set of stress reducing zones (e.g., 1218).

While the second textile 1540 has been described in terms of relative stiffness, other aspects contemplate that this different textile may have other characteristics that are different from the main textile. For example, the second textile may have more drape than the main textile. In another example, the second textile may be a lighter-weight textile as compared to the main textile. In any of these examples, including the second textile still reduces or eliminates the stress present (e.g., tension or compression) at the stress-reducing zones when a wearer bends their arm or raises their arm.

Figure 16:
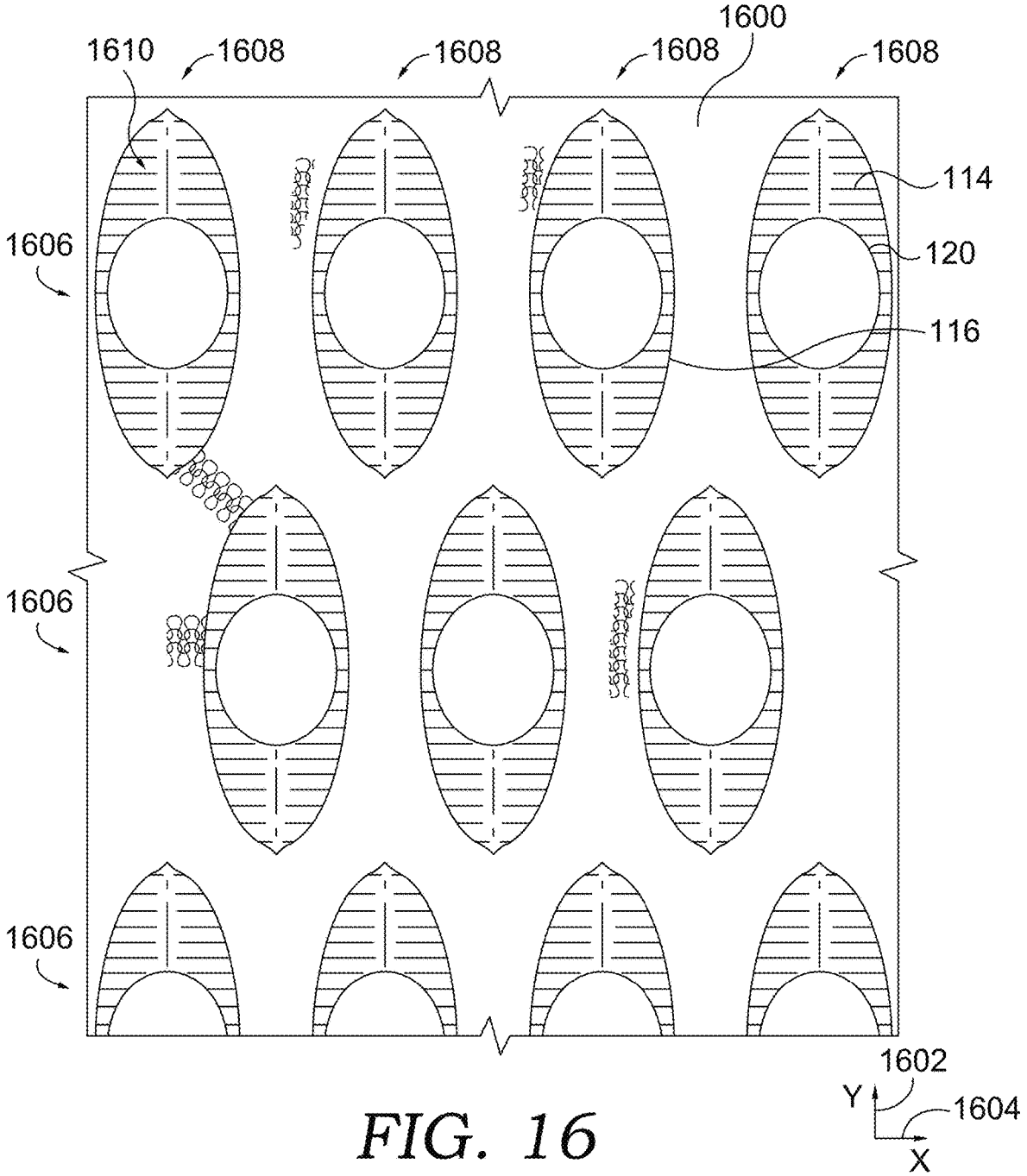
FIG. 16 illustrates a top section view of another example knit spacer textile in accordance with aspects herein.

As discussed herein and seen in FIG. 16, a knit spacer textile 1600 can be warp knitted. That is, the first knit layer, the second knit layer, and the plurality of tie yarns can be created on a warp knitting machine. The first set of apertures in the first knit layer and the second set of apertures in the second knit layer may be integrally formed. Producing the knit spacer textile 1600 in this manner significantly reduces the cost of production and the amount of time required for production.

Producing the knit spacer textile on a warp knitting machine results in the knit spacer textile 1600 having a machine-direction (e.g., the length of the roll of textile) represented by arrow 1602 and a cross-direction (e.g., the width of the roll of textile) represented by arrow 1604. The knit spacer textile 1600 may comprise the knit spacer textile 100 described above and the description above will not be repeated here for sake of brevity. The knit spacer textile 1600 may include rows 1606 of aperture pairs (e.g., pairs of apertures from the first set of apertures and apertures from the second set of apertures) extending across the knit spacer textile 1600 in the cross-direction. The knit spacer textile 1600 may include columns 1608 of aperture pairs extending across the knit spacer textile 1600 in the machine-direction. Adjacent rows in the machine-direction of aperture pairs may be offset from one another in the cross-direction in order to provide more pair of apertures across the knit spacer textile 1600.

As discussed above, the apertures of both the first set of apertures and the second set of apertures may take a variety of shapes. The apertures illustrated in FIG. 16 have an oblong shape with a long axis in the machine-direction and a short axis in the cross-direction. As a result, the pairs of apertures present an oblong-funnel structure through the knit spacer textile 1600. The tie yarns of the knit spacer textile 1600 may define a beveled edge 1610 between the first knit layer and the second knit layer of the knit spacer textile 1600.

As illustrated in the FIG. 16, the beveled edge 1610 may steeper (i.e., the tie yarns may be nearer to perpendicular to the first knit layer) towards the center of the pair of apertures in the machine-direction and the beveled edge 1610 may be less steep (i.e., the tie yarns may be farther from perpendicular to the first knit layer) towards the front and rear of the pair of apertures in the machine-direction. In other words, the beveled edge 1610 (and/or the tie yarns) have a greater cross-direction vector length at the front and rear of the pair of apertures than at the center of the pair of apertures.

In aspects, when constructing a garment from any of the textiles described herein (e.g., textiles 100, 150, 170, 1600, etc.) the orientation of the first set of apertures (e.g., apertures 116, 156, 178, etc.) and the second set of apertures (e.g., apertures 120, 160, etc.) can provide advantages. For example, when the first set of apertures (e.g., apertures 116, 156, 178, etc.) and the second set of apertures (e.g., apertures 120, 160, etc.) are oblong, it is advantageous to orient a long axis of said apertures in the garment in a vertical direction when the garment is in an as-worn configuration. This orientation may inhibit drooping of the apertures (e.g., such as a perimeter edge). Thus, in an example where the knit spacer textile is warp knitted, aligning the machine-direction of the knit spacer textile in a vertical direction of the garment in an as-worn configuration.

In an upper body garment, for example, the long axis of the apertures (or the machine direction of the knit spacer textile) may be oriented such that it extends from a neck opening to a waist opening. Likewise, in a lower body garment, for example, the long axis of the apertures (or the machine direction of the knit spacer textile) may be oriented such that it extends from a waist opening to a leg opening. Since the knit spacer textile is a substantially flat sheet of material and the garment formed from the knit spacer textile is not a perfect cylinder (i.e., the garment has an irregular three-dimensional shape), not all of the long axis of the apertures (or all of the machine direction) will be perpendicular to the neck opening or waist opening in a completed garment. Even with this slight skewing of the alignment of the knit spacer textile near a portion of an opening of the garment, the knit spacer textile as a whole will keep the long axis of the apertures (or the machine direction of the knit spacer textile) substantially in an orientation that will resist drooping of the apertures.

In some aspects, the tie yarns interlooped proximate the apertures in the first layer and visible through the such apertures may extend different lengths. For example, a first group of the tie yarns may extend from a position proximate a perimeter of a respective aperture in the first layer to a position proximate a second perimeter of a respective aperture in the second layer. Continuing with this example, a second group of the tie yarns may extend from a position proximate the perimeter of the respective aperture in the first layer to a position on the second layer that is not immediately adjacent to the second perimeter of the respective aperture in the second layer (yet is still visible through the aperture in the first layer). In aspects where the aperture in the first layer has an oblong shape, the first group of tie yarns may extend a shorter distance than the second group of tie yarns. In some examples, the tie yarns may extend in the cross-direction across the textile. In some examples, the tie yarns visible through the aperture in the first layer that are above or below, in the machine direction, the respective aperture in the second layer may extend to a split line on the second layer. Tie yarns in this above or below region may extend from a position proximate the first perimeter of the aperture in the first layer to the split line. The split line may be a center line of the aperture in the first layer. For example, the continuously extending aperture through the textile (e.g., the aperture in the first layer to the aperture in the second layer through a thickness of the textile) may present as a mirror image in the cross-direction across the split line. In some aspects, the split line is a course of the second layer where each of the tie yarns is interlooped in the region above or below, in the machine direction, the aperture in the second layer. Because a shape of the aperture in the first layer may have a perimeter spaced a different distance from the split line, different tie yarns interlooped along the perimeter may extend a different distance to the second layer.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A knit spacer textile comprising: a first knit layer comprising a first plurality of yarns, the first knit layer comprising a first set of apertures having a first opening size; a second knit layer comprising a second plurality of yarns, the second knit layer comprising a second set of apertures, each aperture in the second set of apertures axially aligned with a corresponding aperture in the first set of apertures, the second set of apertures having a second opening size different from the first opening size; and a plurality of tie yarns that interconnect the first knit layer and the second knit layer.

Clause 2. The knit spacer textile of clause 1, wherein the second plurality of yarns is more hydrophobic than the first plurality of yarns.

Clause 3. The knit spacer textile of any of clauses 1 through 2, wherein the first plurality of yarns is more hydrophilic than the second plurality of yarns.

Clause 4. The knit spacer textile of any of clauses 1 through 3, wherein the plurality of tie yarns is moisture wicking.

Clause 5. The knit spacer textile of any of clauses 1 through 4, wherein the plurality of tie yarns is more hydrophilic than the second plurality of yarns.

Clause 6. The knit spacer textile of any of clauses 1 through 5, wherein the first plurality of yarns is more hydrophilic than the plurality of tie yarns.

Clause 7. The knit spacer textile of any of clauses 1 through 6, wherein each of the first plurality of yarns, the second plurality of yarns, and the plurality of tie yarns comprises one or more of natural fibers and semi-synthetic fibers.

Clause 8. The knit spacer textile of any of clauses 1 through 7, wherein the first plurality of yarns comprises a natural fiber based yarn or a keratin based fiber yarn.

Clause 9. The knit spacer textile of any of clauses 1 through 8, wherein the first opening size is at least about 1.5 to 2 times larger than the second opening size.

Clause 10. The knit spacer textile of any of clauses 1 through 9, wherein the first opening size comprises a dimension between about 5 mm and about 22 mm and the second opening size comprises a dimension between about 2 mm and about 10 mm.

Clause 11. The knit spacer textile of any of clauses 1 through 10, wherein the first opening size comprises a first area and the second opening size comprises a second area smaller than the first area.

Clause 12. The knit spacer textile of any of clauses 1 through 11, wherein each of the first set of apertures are spaced apart from an adjacent aperture by a first distance between about 2 mm and about 8 mm and each of the second set of apertures are spaced apart from an adjacent aperture by a second distance between about 4 mm and about 7 mm.

Clause 13. The knit spacer textile of any of clauses 1 through 12, wherein the first knit layer has an aperture density between about 1.5 and about 5.0 apertures per cm2 and the second knit layer has an aperture density between about 1.0 and about 5.0 apertures per cm2.

Clause 14. The knit spacer textile of any of clauses 1 through 13 further comprising a first zone and a second zone, wherein at least one of the size, spacing, density, shape, or alignment of the first set of apertures and the second set of apertures is different between the first zone and the second zone.

Clause 15. The knit spacer textile of any of clauses 1 through 14, wherein the first zone is located adjacent a perimeter edge of the textile and the second zone is located on an opposite side of the first zone from the perimeter edge.

Clause 16. The knit spacer textile of any of clauses 1 through 15, wherein a portion of the plurality of tie yarns extend from a first position adjacent a first aperture of the first set of apertures to a second position adjacent a second aperture of the second set of apertures such that the portion of the plurality of tie yarns are visible through the first aperture.

Clause 17. The knit spacer textile of any of clauses 1 through 16, wherein the first set of apertures have a first shape and the second set of apertures have a second shape.

Clause 18. The knit spacer textile of any of clauses 1 through 17, wherein the first shape is one of elliptical, circular, rectangular, ovoid, oblong, or spindle shaped and the second shape is one of elliptical, circular, rectangular, ovoid, oblong, or spindle shaped.

Clause 19. The knit spacer textile of any of clauses 1 through 18, wherein the second shape is different from the first shape.

Clause 20. A garment comprising: a knit spacer textile forming one or more portions of the garment, the knit spacer textile comprising: a first knit layer formed from a first plurality of yarns, the first knit layer comprising a first set of apertures having a first opening size; a second knit layer formed from a second plurality of yarns, the second knit layer comprising a second set of apertures, the second set of apertures having a second opening size less than the first opening size; and a plurality of tie yarns that interconnect the first knit layer and the second knit layer.

Clause 21. The garment of clause 20, wherein the garment comprises one of an upper-torso garment or a lower-torso garment.

Clause 22. The garment of any of clauses 20 through 21, wherein the upper-torso garment comprises one of a shirt, a tank top, or a sleeveless top.

Clause 23. The garment of any of clauses 20 through 22, wherein the lower-torso garment comprises pants or shorts.

Clause 24. The garment of any of clauses 20 through 23, wherein the first knit layer forms an outermost-facing surface of the garment and wherein the second knit layer forms an innermost-facing surface of the garment.

Clause 25. The garment of any of clauses 20 through 24, wherein each aperture in the second set of apertures is axially aligned with a corresponding aperture in the first set of apertures.

Clause 26. The garment of any of clauses 20 through 25, wherein the first plurality of yarns is more hydrophilic than the second plurality of yarns, and the plurality of tie yarns is moisture wicking.

Clause 27. The garment of any of clauses 20 through 26, wherein each of the first plurality of yarns, the second plurality of yarns, and the plurality of tie yarns comprises one or more of natural fibers and semi-synthetic fibers.

Clause 28. The garment of any of clauses 20 through 27, wherein the first plurality of yarns comprises a cellulosic fiber or a keratin fiber.

Clause 29. A knit spacer textile comprising: a first knit layer comprising a first plurality of yarns, the first knit layer comprising a first set of apertures; a second knit layer comprising a second plurality of yarns, the second knit layer comprising a second set of apertures, each aperture in the second set of apertures aligned with a corresponding aperture in the first set of apertures such that a continuous opening is formed through a thickness of the knit spacer textile; and a plurality of tie yarns that interconnect the first knit layer and the second knit layer.

Clause 30. The knit spacer textile of clause 29, wherein the knit spacer textile has a machine direction and a cross-direction and wherein each of the first set of apertures and each of the second set of apertures are elongated and oriented such that a major axis is parallel to the machine direction.

Clause 31. The knit spacer textile of any of clauses 29 through 30, wherein each aperture in the first set of apertures has a first opening size and each aperture in the second apertures has a second opening size different from the first opening size.

Clause 32. The knit spacer textile of any of clauses 29 through 31, wherein each continuous opening tapers gradually from the first layer to the second layer.

Clause 33. The knit spacer textile of any of clauses 29 through 32, wherein each aperture in the second set of apertures is axially aligned with a corresponding aperture in the first set of apertures.

Clause 34. The knit spacer textile of any of clauses 29 through 33, wherein a first portion of the tie yarns extend from a first perimeter of a first aperture in the first set of apertures to a second perimeter of a second aperture in the second set of apertures, wherein a second portion of the tie yarns extend from the first perimeter to the second knit layer, wherein each of the first portion of tie yarns and the second portion of tie yarns are visible through the first aperture from the first layer side of the knit spacer textile.

Clause 35. The knit spacer textile of any of clauses 29 through 34 further comprising a first zone and a second zone, wherein in the first zone a first length of one or more first segments of tie yarns extending from the first layer to the second layer is different from a second length of one or more second segments of tie yarns extending from the first layer to the second layer in the second zone.

Clause 36. The knit spacer textile of any of clauses 29 through 35, wherein each of the first zone and the second zone is positioned in the continuous opening.

Clause 37. The knit spacer textile of any of clauses 29 through 36, wherein the knit spacer textile is an integrally knit textile.

Clause 38. The knit spacer textile of any of clauses 29 through 37, wherein each aperture in the first set of apertures and each aperture in the second set of apertures have a same size and shape such that each continuous opening has uniform thickness in a z-direction.

Clause 39. The knit spacer textile of any of clauses 29 through 38, wherein the knit spacer textile has an average thickness in a range from about 1.05 mm to about 12.7 mm.

Clause 40. The knit spacer textile of any of clauses 29 through 39, wherein the knit spacer textile comprises a portion of a garment.

Clause 41. The knit spacer textile of any of clauses 29 through 40, wherein the first layer forms an external facing side of the garment and the second layer forms a skin-facing side of the garment.

Clause 42. The knit spacer textile of any of clauses 29 through 41, wherein one or more of the first plurality of yarns, the second plurality of yarns, and the plurality of tie yarns have a hydrophilic finish.

Clause 43. The knit spacer textile of any of clauses 29 through 42 further comprising a hydrophilic finish on one or more of a first side of the textile and a second side of the textile, the first side comprising the first plurality of yarns and the second side comprising the second plurality of yarns.

Clause 44. The knit spacer textile of clause 29, wherein one or more of the first plurality of yarns, the second plurality of yarns, and the plurality of tie yarns comprise polyester, recycled polyester, polymide, or recycled polyamide.

Clause 45. The knit spacer textile of any of clauses 29 through 43, wherein one or more of the first plurality of yarns, the second plurality of yarns, and the plurality of tie yarns comprise a natural fiber or a semi-synthetic fiber.

Clause 46. The knit spacer textile of any of clauses 29 through 44, wherein one or more of the first plurality of yarns, the second plurality of yarns, and the plurality of tie yarns comprise a cellulosic fiber or a regenerated cellulosic fiber.

Clause 47. An integrally knit spacer textile comprising: a first knit layer comprising a first plurality of yarns; a second knit layer comprising a second plurality of yarns; a plurality of tie yarns that interconnect the first knit layer and the second knit layer; and a plurality of continuous openings, each of the plurality of continuous openings extending from the first knit layer to the second knit layer and through a thickness of the textile.

Clause 48. The integrally knit spacer textile of clause 47, wherein each of the continuous openings have a first perimeter at the first knit layer and a second perimeter at the second knit layer, the second perimeter smaller than the first perimeter.

Clause 49. The integrally knit spacer textile of any of clauses 47 through 48, wherein the first perimeter and the second perimeter are visible through the continuous opening when viewed from the first knit layer side of the integrally knit spacer textile.

Clause 50. The integrally knit spacer textile of any of clauses 47 through 49, wherein the continuous openings further comprise a side wall, the side wall comprising a portion of the plurality of tie yarns that extend between the first knit layer and the second knit layer.

Clause 51. The integrally knit spacer textile of any of clauses 47 through 50, wherein the continuous openings comprise a nozzle that increases the velocity of air flowing therethrough.

Clause 52. A method of manufacturing a knit spacer textile comprising: knitting a first plurality of yarns to form a first knit layer, wherein knitting the first plurality of yarns to form the first knit layer includes forming a first set of apertures having a first opening size; knitting a second plurality of yarns to form a second knit layer, wherein knitting the second plurality of yarns to form the second knit layer includes forming a second set of apertures, each aperture in the second set of apertures axially aligned with a corresponding aperture in the first set of apertures, the second set of apertures having a second opening size less than the first opening size; and interconnecting the first knit layer with the second knit layer using a plurality of tie yarns.

Clause 53. The method of manufacturing the knit spacer textile of clause 52, wherein the first plurality of yarns is more hydrophilic than the second plurality of yarns.

Clause 54. The method of manufacturing the knit spacer textile of any of clauses 52 through 53, wherein the plurality of tie yarns is moisture wicking.

Clause 55. The method of any of clauses 52 through 54 further comprising performing a post-knitting treatment on the knit spacer textile.

Clause 56. The method of any of clauses 52 through 55, wherein the post-knitting treatment comprises heat-setting the knit spacer textile.

Clause 57. The method of any of clauses 52 through 56, wherein the post-knitting treatment comprises applying a coating to one or more of the first knit layer and the second knit layer of the knit spacer textile.

Clause 58. The method of any of clauses 52 through 57, wherein the post-knitting treatment comprises sublimation printing on one or more of the first knit layer and the second knit layer of the knit spacer textile.

Clause 59. The method of any of clauses 52 through 58, wherein the post-knitting treatment comprises molding the knit spacer textile.

Clause 60. The method of any of clauses 52 through 59, wherein molding the knit spacer textile comprises applying one or more of heat and pressure to the knit spacer textile with a mold to create one or more of a surface pattern, an indentation, and a raised structure on one or more of the first knit layer and the second knit layer.

Clause 61. A knit spacer textile comprising: a first knit layer formed from a first plurality of yarns, the first knit layer comprising a first set of apertures having a first opening size; a second knit layer formed from a second plurality of yarns, the second knit layer comprising a second set of apertures, the second set of apertures having a second opening size different from the first opening size; and a plurality of tie yarns that interconnect the first knit layer and the second knit layer, wherein a portion of the plurality of tie yarns extend from a first position adjacent a first aperture of the first set of apertures to a second position adjacent a second aperture of the second set of apertures such that the portion of the plurality of tie yarns are visible through the first aperture.

Clause 62. The knit spacer textile of clause 61, wherein each aperture in the second set of apertures is axially aligned with a corresponding aperture in the first set of apertures.

Clause 63. The knit spacer textile of any of clauses 61 through 62, wherein the portion of the plurality of tie yarns provide a beveled surface between the first knit layer and the second knit layer.

Clause 64. The knit spacer textile of any of clauses 61 through 63, wherein the beveled surface extends from a perimeter of the first aperture to a perimeter of the second aperture, wherein the beveled surface includes a first angle to the first knit layer at a first location along the perimeter of the first aperture, wherein the beveled surface includes a second angle to the first knit layer at a second location along the perimeter of the first aperture.

Clause 65. The knit spacer textile of any of clauses 61 through 64, wherein the second plurality of yarns is more hydrophobic than the first plurality of yarns.

Clause 66. The knit spacer textile of any of clauses 61 through 65, wherein the first plurality of yarns is more hydrophilic than the second plurality of yarns.

Clause 67. The knit spacer textile of any of clauses 61 through 66, wherein the plurality of tie yarns is moisture wicking.

Clause 68. The knit spacer textile of any of clauses 61 through 67, wherein each of the first plurality of yarns, the second plurality of yarns, and the plurality of tie yarns comprises one or more of natural fibers and semi-synthetic fibers.

Clause 69. The knit spacer textile of any of clauses 61 through 68, wherein the first plurality of yarns comprises one or more of cotton and wool.

Clause 70. The knit spacer textile of any of clauses 61 through 69, wherein the first opening size is at least about 1.5 to 2 times larger than the second opening size.

Clause 71. A knit spacer textile comprising: a first knit layer formed from a first plurality of yarns, the first knit layer comprising a first set of apertures having a first opening size; a second knit layer formed from a second plurality of yarns, the second knit layer comprising a second set of apertures, the second set of apertures having a second opening size less than the first opening size; and a plurality of tie yarns that interconnect the first knit layer and the second knit layer.

Clause 72. The knit spacer textile of clause 71, wherein at least one of the first plurality of yarns, the second plurality of yarns, and the plurality of tie yarns comprises a yarn having a denier of at least 70 D.

Clause 73. The knit spacer textile of any of clauses 71 through 72, wherein at least one of the first plurality of yarns, the second plurality of yarns, and the plurality of tie yarns comprises a yarn having a denier in the range of about 70 D to about 160 D.

Clause 74. The knit spacer textile of any of clauses 71 through 73, wherein at least one of the first plurality of yarns, the second plurality of yarns, and the plurality of tie yarns comprises a yarn having a denier of about 80 D.

Clause 75. The knit spacer textile of any of clauses 71 through 74, wherein at least one of the first plurality of yarns, the second plurality of yarns, and the plurality of tie yarns comprises a yarn having a tenacity in the range of about 3.0 to about 5.0 grams per denier.

Clause 76. The knit spacer textile of any of clauses 71 through 75, wherein at least one of the first plurality of yarns, the second plurality of yarns, and the plurality of tie yarns comprises a yarn having a tenacity in the range of about 3.6 to about 4.8 grams per denier.

Clause 77. The knit spacer textile of any of clauses 71 through 76, wherein at least one of the first plurality of yarns, the second plurality of yarns, and the plurality of tie yarns comprises a yarn having a tenacity of about 4.0 grams per denier.

Clause 78. The knit spacer textile of any of clauses 71 through 77, wherein at least one of the first plurality of yarns, the second plurality of yarns, and the plurality of tie yarns comprises a multifilament yarn having a denier per filament in the range of about 0.5 to about 2.5.

Clause 79. The knit spacer textile of any of clauses 71 through 78, wherein at least one of the first plurality of yarns, the second plurality of yarns, and the plurality of tie yarns comprises a multifilament yarn having a denier per filament of less than 0.75.

Clause 80. The knit spacer textile of any of clauses 71 through 79, wherein at least one of the first plurality of yarns, the second plurality of yarns, and the plurality of tie yarns comprises a multifilament yarn having a denier per filament of about 1.04.

Clause 81. The knit spacer textile of any of clauses 71 through 80, wherein at least one of the first plurality of yarns, the second plurality of yarns, and the plurality of tie yarns comprises a multifilament yarn having a denier per filament of about 2.08.

Clause 82. The knit spacer textile of any of clauses 71 through 81, wherein at least one of the first plurality of yarns, the second plurality of yarns, and the plurality of tie yarns comprises a yarn having a moisture regain percentage in the range from about 9.0% to about 13.0%.

Clause 83. The knit spacer textile of any of clauses 71 through 82, wherein at least one of the first plurality of yarns, the second plurality of yarns, and the plurality of tie yarns comprises a yarn having a moisture regain percentage of about 10%.

Clause 84. The knit spacer textile of any of clauses 71 through 83, wherein the knit spacer textile has a stiffness measured according to ASTM D4032-2008 in the range of about 0.02 kgf to about 0.60 kgf.

Clause 85. The knit spacer textile of any of clauses 71 through 84, wherein the knit spacer textile has a stiffness measured according to ASTM D4032-2008 in the range of about 0.07 kgf to about 0.13 kgf.

Clause 86. The knit spacer textile of any of clauses 71 through 85, wherein the knit spacer textile has a stiffness measured according to ASTM D4032-2008 in the range of about 0.09 kgf to about 0.11 kgf.

Clause 87. The knit spacer textile of any of clauses 71 through 86, wherein the knit spacer textile has a stiffness measured according to ASTM D4032-2008 of about 0.101 kgf.

Clause 88. The knit spacer textile of any of clauses 71 through 87, wherein the knit spacer textile has a thickness measured according to ASTM D1777-2019, Option 5, in the range of about 1.10 mm to about 1.60 mm.

Clause 89. The knit spacer textile of any of clauses 71 through 88, wherein the knit spacer textile has a thickness measured according to ASTM D1777-2019, Option 5, in the range of about 1.35 mm to about 1.42 mm.

Clause 90. The knit spacer textile of any of clauses 71 through 89, wherein the knit spacer textile has a thickness measured according to ASTM D1777-2019, Option 5, of about 1.38 mm.

Clause 91. The knit spacer textile of any of clauses 71 through 90, wherein the knit spacer textile has a thickness measured according to ISO 5084-1996 in the range of about 1.50 mm to about 2.10 mm.

Clause 92. The knit spacer textile of any of clauses 71 through 91, wherein the knit spacer textile has a thickness measured according to ISO 5084-1996 in the range of about 1.70 mm to about 1.80 mm.

Clause 93. The knit spacer textile of any of clauses 71 through 92, wherein the knit spacer textile has a thickness measured according to ISO 5084-1996 of about 1.75 mm.

Clause 94. The knit spacer textile of any of clauses 71 through 93, wherein the second plurality of yarns has an instantaneous heat transfer value in the range of 0.10 $W/cm^2$ to 0.30 $W/cm^2$.

Clause 95. The knit spacer textile of any of clauses 71 through 94, wherein the second plurality of yarns has an instantaneous heat transfer value in the range of 0.14 $W/cm^2$ to 0.235 $W/cm^2$.

Clause 96. The knit spacer textile of any of clauses 71 through 95, wherein the second plurality of yarns has an instantaneous heat transfer value of about 0.25 $W/cm^2$.

Clause 97. The knit spacer textile of any of clauses 71 through 96, wherein respective apertures of the first set of apertures and the second set of apertures are laterally aligned.

Clause 98. The knit spacer textile of any of clauses 71 through 97, wherein the first opening size is greater than the second opening size such that at least a portion of the plurality of tie yarns is visible through the first set of apertures when the knit spacer textile is viewed from the side of the first knit layer.

Clause 99. A garment comprising the knit spacer textile of any of clauses 71 through 98.

Clause 100. The garment of any of clauses 71 through 99, wherein the garment comprises an upper-body garment.

Clause 101. The garment of any of clauses 71 through 100, wherein the upper-body garment comprises a shirt, tank top, or sleeveless top.

Clause 102. The garment of any of clauses 71 through 101, wherein the garment comprises a lower-body garment.

Clause 103. The garment of any of clauses 71 through 102, wherein the lower-body garment comprises shorts or pants.

Clause 104. The garment of any of clauses 71 through 103, wherein the garment comprises both an upper-body portion and a lower-body portion.

Clause 105. The garment of any of clauses 71 through 104, wherein the upper-body portion comprises a shirt, tank top, or sleeveless top, and the lower-body portion comprises shorts or pants.

Clause 106. A garment comprising: a first area of the garment comprising a knit spacer textile; and a second area of the garment comprising the knit spacer textile, wherein the first knit spacer textile comprises a first knit layer formed from a first plurality of yarns, a second knit layer formed from a second plurality of yarns, and a plurality of tie yarns that interconnect the first knit layer and the second knit layer, wherein the first knit layer comprising a first set of apertures in the first area, the first set of apertures having a first opening size, the first knit layer comprising a second set of apertures in the second area, the second set of apertures having a second opening size, the first opening size being greater than the second opening size, wherein the second knit layer comprising a third set of apertures in the first area, the third set of apertures having a third opening size, the second knit layer comprising a fourth set of apertures in the second area, the fourth set of apertures having a fourth opening size, the third opening size being greater than the fourth opening size.

Clause 107. The garment of clause 106, wherein the garment comprises an upper-body garment.

Clause 108. The garment of any of clauses 106 through 107, wherein the upper-torso garment comprises one of a shirt, a tank top, or a sleeveless top.

Clause 109. The garment of any of clauses 106 through 108, wherein the first area is associated with a chest region of the upper-body garment and the second area is associated with a sleeve region of the upper-body garment.

Clause 110. The garment of any of clauses 106 through 109 further comprising a central region and a perimeter edge, wherein the first area is located in the central region and the second area is positioned between the first area and the perimeter edge.

Clause 111. The garment of any of clauses 106 through 110, wherein the garment comprises a lower-body garment.

Clause 112. The garment of any of clauses 106 through 111, wherein the lower-body garment comprises shorts or pants.

Clause 113. The garment of any of clauses 106 through 112, wherein the first area is associated with a pelvic region of the lower-body garment and the second area is associated with a leg region of the lower-body garment.

Clause 114. The garment of any of clauses 106 through 113 further comprising a central region and a perimeter edge, wherein the first area is located in the central region and the second area is positioned between the first area and the perimeter edge.

Clause 115. The garment of any of clauses 106 through 114, wherein the garment comprises both an upper-body portion and a lower-body portion.

Clause 116. The garment of any of clauses 106 through 115, wherein the upper-body portion comprises a shirt, tank top, or sleeveless top, and the lower-body portion comprises shorts or pants.

Clause 117. The garment of any of clauses 106 through 116, wherein the first area is a region of the garment configured to be positioned over an undergarment and the second area is a second region of the garment configured to not be positioned over an undergarment.

Clause 118. The garment of any of clauses 106 through 117, wherein a portion of the plurality of tie yarns extend from a first position adjacent a first aperture of the first set of apertures to a third position adjacent a third aperture of the third set of apertures such that the portion of the plurality of tie yarns are visible through the first aperture, wherein a second portion of the plurality of tie yarns extend from a second position adjacent a second aperture of the second set of apertures to a fourth position adjacent a fourth aperture of the fourth set of apertures such that the second portion of the plurality of tie yarns are visible through the second aperture.

Clause 119. The garment of any of clauses 106 through 118, wherein the first opening size is greater than the third opening size and the second opening size is greater than the fourth opening size.

Clause 120. The garment of any of clauses 106 through 119, wherein each first aperture of the first set of apertures is respectively aligned with a respective third aperture of the third set of apertures in the first area, wherein each aperture of the second set of apertures is respectively aligned with a respective fourth aperture of the fourth set of apertures in the second area.

Clause 121. The garment of any of clauses 106 through 120, wherein the second plurality of yarns is more hydrophobic than the first plurality of yarns.

Clause 122. The garment of any of clauses 106 through 121, wherein the first plurality of yarns is more hydrophilic than the second plurality of yarns.

Clause 123. The garment of any of clauses 106 through 122, wherein the plurality of tie yarns is moisture wicking.

Clause 124. The garment of any of clauses 106 through 123, wherein each of the first plurality of yarns, the second plurality of yarns, and the plurality of tie yarns comprises one or more of natural fibers and semi-synthetic fibers.

Clause 125. The garment of any of clauses 106 through 124, wherein the first plurality of yarns comprises one or more of cotton and wool.

Clause 126. The garment of any of clauses 106 through 125, wherein the first opening size is equal to the third opening size and the second opening size is equal to the fourth opening size.

Clause 127. The garment of any of clauses 106 through 126, wherein the first area has a first stiffness and the second area has a second stiffness.

Clause 128. A garment comprising: a first textile positioned in a first area of the garment; and a knit spacer textile positioned in a second area of the garment, the first textile coupled to the knit spacer textile, wherein the knit spacer textile comprises a first knit layer formed from a first plurality of yarns, the first knit layer comprising a first set of apertures having a first opening size, a second knit layer formed from a second plurality of yarns, the second knit layer comprising a second set of apertures, each aperture in the second set of apertures axially aligned with a corresponding aperture in the first set of apertures, the second set of apertures having a second opening size different from the first opening size, and a plurality of tie yarns that interconnect the first knit layer and the second knit layer.

Clause 129. The garment of clause 128, wherein the first textile is a knit textile.

Clause 130. The garment of any of clauses 128 through 129, wherein the first textile does not have the first set of apertures or the second set of apertures of the knit spacer textile.

Clause 131. The garment of any of clauses 128 through 130, wherein the first textile has a first edge and the knit spacer textile has a second edge, wherein the first edge is joined to the second edge.

Clause 132. The garment of any of clauses 128 through 131, wherein the first edge is joined to the second edge at a seam.

Clause 133. The garment of any of clauses 128 through 132, wherein the first textile is more hydrophobic relative to the second knit layer of the knit spacer textile.

Clause 134. The garment of any of clauses 128 through 133, wherein the first textile comprises a cellulose textile that is treated on a surface with a durable water repellant finish.

Clause 135. The garment of any of clauses 128 through 134, wherein the first plurality of yarns is more hydrophilic than the second plurality of yarns.

Clause 136. The garment of any of clauses 128 through 135, wherein the second area is associated with an elevated sweat zone of the garment.

Clause 137. The garment of any of clauses 128 through 136, wherein the garment comprises an upper-body garment.

Clause 138. The garment of any of clauses 128 through 137, wherein the second area is associated with an underarm region of the upper-body garment.

Clause 139. The garment of any of clauses 128 through 138, wherein the first area is associated with a medial torso region of the upper-body garment and the second area is associated with a lateral torso region of the upper-body garment.

Clause 140. The garment of any of clauses 128 through 139, wherein the first area comprises a lateral region of an arm of the upper-body garment and the second area comprises a medial region of the arm of the upper-body garment.

Clause 141. The garment of any of clauses 128 through 140, wherein the upper-body garment comprises a shirt.

Clause 142. The garment of any of clauses 128 through 141, wherein the garment comprises a lower-body garment.

Clause 143. The garment of any of clauses 128 through 142, wherein the second area is associated with a pelvic region of the lower-body garment.

Clause 144. The garment of any of clauses 128 through 143, wherein the lower-body garment comprises a pant or a short.

Clause 145. The garment of any of clauses 128 through 144, wherein a portion of the plurality of tie yarns extend from a first position adjacent a first aperture of the first set of apertures to a second position adjacent a second aperture of the second set of apertures such that the portion of the plurality of tie yarns are visible through the first aperture.

Clause 146. The garment of any of clauses 128 through 145, wherein the first plurality of yarns is more hydrophilic than the second plurality of yarns.

Clause 147. The garment of any of clauses 128 through 146, wherein the plurality of tie yarns is moisture wicking.

Clause 148. The garment of any of clauses 128 through 147, wherein each of the first plurality of yarns, the second plurality of yarns, and the plurality of tie yarns comprises one or more of natural fibers and semi-synthetic fibers.

Clause 149. The garment of any of clauses 128 through 148, wherein the first plurality of yarns comprises one or more of cotton and wool.

Clause 150. The garment of any of clauses 128 through 149, wherein the first opening size is equal to the second opening size.

Clause 151. An upper-body garment comprising: a torso portion; a left arm portion extending from the torso portion; and a right arm portion extending from the torso portion, wherein the torso portion, the left arm portion, and the right arm portion each comprise a knit spacer textile, wherein the knit spacer textile comprises a first knit layer formed from a first plurality of yarns, the first knit layer comprising a first set of apertures having a first opening size, a second knit layer formed from a second plurality of yarns, the second knit layer comprising a second set of apertures, each aperture in the second set of apertures axially aligned with a corresponding aperture in the first set of apertures, the second set of apertures having a second opening size different from the first opening size, and a plurality of tie yarns that interconnect the first knit layer and the second knit layer, and wherein the left arm portion and the right arm portion each include a stress relief zone.

Clause 152. The garment of clause 151, wherein each stress relief zone is positioned on each of the left arm portion and the right arm portion proximate an area associated with a crook of the elbow of a wearer when the garment is donned.

Clause 153. The garment of any of clauses 151 through 152, wherein each stress relief zone is configured to relieve compression experienced at the area associated with a crook of the elbow of the wearer when the wearer bends or flexes their arm.

Clause 154. The garment of any of clauses 151 through 153, wherein each stress relief zone comprises a cut-out formed in each of the left arm portion and the right arm portion.

Clause 155. The garment of any of clauses 151 through 154, wherein the cut-out has one of a circular or elliptical shape.

Clause 156. The garment of any of clauses 151 through 155, wherein each stress relief zone comprises an opening integrally formed in each of the left arm portion and the right arm portion.

Clause 157. The garment of any of clauses 151 through 156, wherein the opening is at least five times larger than any of the apertures of the knit spacer textile.

Clause 158. The garment of any of clauses 151 through 157, wherein the opening is integrally formed in both the first knit layer and the second knit layer of the knit spacer textile.

Clause 159. The garment of any of clauses 151 through 158, wherein each stress relief zone extends across at least 50% of the circumference of the left arm portion and the right arm portion.

Clause 160. The garment of any of clauses 151 through 159, wherein each stress relief zone is positioned on the anterior side of the left arm portion and the right arm portion.

Clause 161. The garment of any of clauses 151 through 160, wherein a center line extending in the lateral to medial direction of each stress relief zone is positioned adjacent to a location associated with a crease of the elbow of the wearer.

Clause 162. The garment of any of clauses 151 through 161, wherein each stress relief zone comprises a proximal half and a distal half divided by the center line.

Clause 163. The garment of any of clauses 151 through 162, wherein a most proximal point of the proximal half is from about 0.5 inches to about 2 inches up the arm portion from the center line.

Clause 164. The garment of any of clauses 151 through 163, wherein a most distal point of the distal half is from about 0.5 inches to about 2 inches up the arm portion from the center line.

Clause 165. The garment of any of clauses 151 through 164 further comprising a second textile panel joined to the right arm portion at the perimeter of the stress relief zone and a third textile panel joined to the left arm portion at the perimeter of the respective stress relief zone.

Clause 166. The garment of any of clauses 151 through 165, wherein the second textile panel and the third textile panel each comprise the same type of textile.

Clause 167. The garment of any of clauses 151 through 166, wherein the second textile panel and the third textile panel have a lower stiffness than the knit spacer textile.

Clause 168. The garment of any of clauses 151 through 167, wherein stress relief zones are positioned on each of the left arm portion and the right arm portion proximate an area associated with an underarm region of a wearer when the garment is donned.

Clause 169. The garment of any of clauses 151 through 168, wherein stress relief zones are positioned on the torso portion adjacent to the left arm portion and the right arm portion.

Clause 170. The garment of any of clauses 151 through 169 wherein respective stress relief zones positioned on the torso portion are aligned with the stress relief zones positioned on the left arm portion and the right arm portion.

Clause 171. The garment of any of clauses 151 through 170, wherein the stress relief zones comprise seam openings at a first seam joining the left arm portion to the torso portion and a second seam joining the right arm portion to the torso portion.

Clause 172. The garment of any of clauses 151 through 171, wherein each stress relief zone is configured to relieve tension experienced at the area associated with an underarm region of the wearer when their arm is lifted overhead.

Clause 173. The garment of any of clauses 151 through 172, wherein each stress relief zone extends across at least 50% of the circumference of the left arm portion and the right arm portion.

Clause 174. An upper-body garment comprising: a torso portion; a left arm portion extending from the torso portion; and a right arm portion extending from the torso portion, wherein the torso portion, the left arm portion, and the right arm portion each comprise a textile, wherein the textile comprises a first knit layer formed from a first plurality of yarns, the first knit layer comprising a first set of apertures having a first opening size, a second knit layer formed from a second plurality of yarns, the second knit layer comprising a second set of apertures, each aperture in the second set of apertures axially aligned with a corresponding aperture in the first set of apertures, wherein the upper-body garment comprises one or more vent zones.

Clause 175. The upper-body garment of clause 174, wherein the one or more vent zones comprises a first vent opening located at a junction between the right arm portion and the torso portion and a second vent opening located at a junction between the left arm portion and the torso portion.

Clause 176. The upper-body garment of any of clauses 174 through 175, wherein the one or more vent zones further comprises a third vent opening located at an inner elbow portion of the right arm portion and a fourth vent opening located at an inner elbow portion of the left arm portion.

Clause 177. The upper-body garment of any of clauses 174 through 176 further comprising a second textile joined to upper-body garment at the one or more vent zones, wherein the textile comprises a first textile.

Clause 178. The upper-body garment of any of clauses 174 through 177, wherein the second textile has a stiffness of less than half of the stiffness of the first textile.

Clause 179. The upper-body garment of any of clauses 174 through 178, wherein an average force of the second textile is less than about 0.60 kgf.

Clause 180. The upper-body garment of any of clauses 174 through 179, wherein the textile further comprises the second set of apertures having a second opening size different from the first opening size, and a plurality of tie yarns that interconnect the first knit layer and the second knit layer.

Clause 181. A textile comprising: a first layer formed from a first plurality of yarns or fibers, the first layer comprising a first set of apertures having a first opening size; and a second layer formed from a second plurality of yarns or fibers, the second layer comprising a second set of apertures, each aperture in the second set of apertures axially aligned with a corresponding aperture in the first set of apertures, the second set of apertures having a second opening size different from the first opening size.

Clause 182. The textile according to clause 181, wherein the first layer comprises one of a knit construction, a woven construction, or a nonwoven construction.

Clause 183. The textile according to any of clauses 181 through 182, wherein the second layer comprises one of a knit construction, a woven construction, or a nonwoven construction.

Clause 184. The textile according to any of clauses 181 through 183, wherein when the first layer and the second layer comprise a nonwoven construction, the first layer is secured to the second layer through fiber entanglement.

Clause 185. The textile according to any of clauses 181 through 184, wherein when the first layer and the second layer comprise a knit construction, the first layer is secured to the second layer through one of tie yarns or yarns transferred between the first layer and the second layer.

Clause 186. The textile according to any of clauses 181 through 185, wherein when the first layer and the second layer comprise a woven construction, the first layer is interwoven with the second layer.

Clause 187. The textile according to any of clauses 181 through 186, wherein the first layer is secured to the second layer through one or more of bonding, adhesives, and stitching.

Clause 188. The textile according to any of clauses 181 through 187, wherein the first layer is relatively more hydrophilic than the second layer.

Clause 189. The textile according to any of clauses 181 through 188, wherein the second opening size is less than the first opening size.

Clause 190. A textile comprising: a first layer formed from a first plurality of yarns or fibers, the first layer comprising a first surface and an opposite second surface, the first layer comprising apertures that extend through the first layer, the apertures having a first opening size at the first surface and a second opening size at the second surface, the second opening size less than the first opening size, and a finish applied to the second surface.

Clause 191. The textile according to clause 190, wherein the first layer comprises one of a knit construction, a woven construction, or a nonwoven construction.

Clause 192. The textile according to any of clauses 190 through 191, wherein the first plurality of yarns or fibers comprises one or more of cotton and wool.

Clause 193. The textile according to any of clauses 190 through 192, wherein the finish is relatively more hydrophobic than the first layer.

Clause 194. The textile according to any of clauses 190 through 193, wherein the finish comprises a durable water repellant.

Clause 195. The textile according to any of clauses 190 through 194, wherein the first opening size is about 1.5 to 2 times the second opening size.

Clause 196. The knit spacer textile of any of clauses 1 through 19 further comprising one or more of a surface pattern in an X-Y plane, an indentation in a Z direction, and a raised structure in a Z direction on one or more of the first knit layer and the second knit layer, wherein the first knit layer and the second knit layer substantially define the X-Y plane.

Clause 197. The knit spacer textile of any of clauses 1 through 19 and 196, wherein the one or more of the surface pattern, the indentation, and the raised structure are formed through a post-knitting process of applying one or more of heat and pressure to the knit spacer textile.

Clause 198. The knit spacer textile of any of clauses 1 through 19 and 196 through 197, wherein at least one of the indentation and the raised structure are molded.

Clause 199. The knit spacer textile of any of clauses 20 through 28 further comprising one or more of a surface pattern in an X-Y plane, an indentation in a Z direction, and a raised structure in a Z direction on one or more of the first knit layer and the second knit layer, wherein the first knit layer and the second knit layer substantially define the X-Y plane.

Clause 200. The knit spacer textile of any of clauses 20 through 28 and 199, wherein the one or more of the surface pattern, the indentation, and the raised structure are formed through a post-knitting process of applying one or more of heat and pressure to the knit spacer textile.

Clause 201. The knit spacer textile of any of clauses 20 through 28 and 199 through 200, wherein at least one of the indentation and the raised structure are molded.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A knit spacer textile comprising:

a first knit layer comprising a first plurality of yarns, the first knit layer comprising a first set of apertures having a first opening size;

a second knit layer comprising a second plurality of yarns, the second knit layer comprising a second set of apertures, each aperture in the second set of apertures axially aligned with a corresponding aperture in the first set of apertures, the second set of apertures having a second opening size different from the first opening size; and a plurality of tie yarns that interconnect the first knit layer and the second knit layer, wherein the plurality of tie yarns include a first portion interlooped with the first knit layer at a perimeter of a first aperture of the first set of apertures and a second portion interlooped with the first knit layer and the second knit layer at an intermediate area between adjacent apertures of the first set of apertures.

2. The knit spacer textile of claim 1, wherein each of the first plurality of yarns and each of the plurality of tie yarns is more hydrophilic than the second plurality of yarns, and wherein the first plurality of yarns is more hydrophilic than the plurality of tie yarns.

3. The knit spacer textile of claim 1, wherein each of the first plurality of yarns, the second plurality of yarns, and the plurality of tie yarns comprises one or more of natural fibers, keratin based fiber yarn, and semi-synthetic fibers.

4. The knit spacer textile of claim 1, wherein the first opening size is at least about 1.5 to 2 times larger than the second opening size.

5. The knit spacer textile of claim 1, wherein the first opening size comprises a dimension between about 5 mm and about 22 mm and the second opening size comprises a dimension between about 2 mm and about 10 mm.

6. The knit spacer textile of claim 1, wherein the first opening size comprises a first area and the second opening size comprises a second area smaller than the first area.

7. The knit spacer textile of claim 1, wherein each of the first set of apertures are spaced apart from an adjacent aperture by a first distance between about 2 mm and about 8 mm and each of the second set of apertures are spaced apart from an adjacent aperture by a second distance between about 4 mm and about 7 mm.

8. The knit spacer textile of claim 1, wherein the first knit layer has an aperture density between about 1.5 and about 5.0 apertures per $cm^2$ and the second knit layer has an aperture density between about 1.0 and about 5.0 apertures per $cm^2$.

9. The knit spacer textile of claim 1, wherein a portion of the plurality of tie yarns extend from a first position adjacent a first aperture of the first set of apertures to a second position adjacent a second aperture of the second set of apertures such that the portion of the plurality of tie yarns are visible through the first aperture.

10. A garment comprising:

a knit spacer textile forming one or more portions of the garment, the knit spacer textile comprising:

a first knit layer comprising a first panel formed from a first plurality of yarns, the first panel comprising a first set of apertures having a first opening size;

a second knit layer comprising a second panel formed from a second plurality of yarns, the second panel comprising a second set of apertures having a second opening size, wherein the second opening size is smaller than the first opening size; and a plurality of tie yarns that interconnect the first panel and the second panel.

11. The garment of claim 10, wherein the garment comprises one of an upper-torso garment or a lower-torso garment.

12. The garment of claim 10, wherein the first knit layer forms an outermost-facing surface of the garment and wherein the second knit layer forms an innermost-facing surface of the garment.

13. The garment of claim 10, wherein each aperture in the second set of apertures is axially aligned with a corresponding aperture in the first set of apertures.

14. A knit spacer textile comprising:

a first knit layer comprising a first plurality of yarns, the first knit layer comprising a first set of apertures;

a second knit layer comprising a second plurality of yarns, the second knit layer comprising a second set of apertures, each aperture in the second set of apertures aligned with a corresponding aperture in the first set of apertures such that a continuous opening is formed through a thickness of the knit spacer textile; and a plurality of tie yarns that interconnect the first knit layer and the second knit layer, wherein the plurality of tie yarns include a first portion interlooped with the first knit layer at a perimeter of a first aperture of the first set of apertures and a second portion interlooped with the first knit layer at an intermediate area between adjacent apertures of the first set of apertures.

15. The knit spacer textile of claim 14, wherein the knit spacer textile has a machine direction and a cross-direction and wherein each of the first set of apertures and each of the second set of apertures are elongated and oriented such that a major axis is parallel to the machine direction, wherein each aperture in the first set of apertures has a first opening size and each aperture in the second set of apertures has a second opening size different from the first opening size.

16. The knit spacer textile of claim 15, wherein each continuous opening tapers gradually from the first knit layer to the second knit layer.

17. The knit spacer textile of claim 15, wherein a first portion of the plurality of tie yarns extend from a first perimeter of a first aperture in the first set of apertures to a second perimeter of a second aperture in the second set of apertures, wherein a second portion of the plurality of tie yarns extend from the first perimeter to the second knit layer, wherein each of the first portion of tie yarns and the second portion of tie yarns are visible through the first aperture from a first layer side of the knit spacer textile.

18. The knit spacer textile of claim 14 further comprising a first zone and a second zone, wherein in the first zone a first length of one or more first segments of tie yarns extending from the first knit layer to the second knit layer is different from a second length of one or more second segments of tie yarns extending from the first knit layer to the second knit layer in the second zone, wherein each of the first zone and the second zone is positioned in the continuous opening.

19. The knit spacer textile of claim 14, wherein the knit spacer textile is an integrally knit textile.

20. The knit spacer textile of claim 14, wherein the knit spacer textile has an average thickness in a range from about 1.05 mm to about 12.7 mm.

21. The knit spacer textile of claim 14, wherein the knit spacer textile comprises a portion of a garment, wherein the first knit layer forms an external facing side of the garment and the second knit layer forms a skin-facing side of the garment.

22. The knit spacer textile of claim 14, wherein one or more of the first plurality of yarns, the second plurality of yarns, and the plurality of tie yarns comprise polyester, recycled polyester, polyamide, or recycled polyamide.

23. The knit spacer textile of claim 14, wherein one or more of the first plurality of yarns, the second plurality of yarns, and the plurality of tie yarns comprise a cellulosic fiber or a regenerated cellulosic fiber.

24. A knit spacer textile comprising:

a first knit layer formed from a first plurality of yarns, the first knit layer comprising a first set of apertures having a first opening size;

a second knit layer formed from a second plurality of yarns, the second knit layer comprising a second set of apertures, the second set of apertures having a second opening size different from the first opening size; and a plurality of tie yarns that interconnect the first knit layer and the second knit layer, wherein a portion of the plurality of tie yarns extend from a first position adjacent a first aperture of the first set of apertures to a second position adjacent a second aperture of the second set of apertures such that the portion of the plurality of tie yarns are visible through the first aperture, wherein an additional portion of the plurality of tie yarns interloop with the first knit layer and the second knit layer at an intermediate area between adjacent apertures of the first set of apertures.

25. The knit spacer textile of claim 24, wherein the portion of the plurality of tie yarns provide a beveled surface between the first knit layer and the second knit layer.

26. The knit spacer textile of claim 25, wherein the beveled surface extends from a perimeter of the first aperture to a perimeter of the second aperture, wherein the beveled surface includes a first angle to the first knit layer at a first location along the perimeter of the first aperture, wherein the beveled surface includes a second angle to the first knit layer at a second location along the perimeter of the first aperture.

27. The knit spacer textile of claim 24, wherein the first plurality of yarns is more hydrophilic than the second plurality of yarns, wherein the plurality of tie yarns is moisture wicking.

28. The knit spacer textile of claim 1, wherein one or more of the first plurality of yarns, the second plurality of yarns, and the plurality of tie yarns comprise a material selected from one or more of polyester, recycled polyester, polyamide, and recycled polyamide.

29. An article of apparel comprising the knit spacer textile of claim 1.

30. The garment of claim 10, wherein the plurality of tie yarns comprise a first portion of tie yarns and a second portion of tie yarns, wherein the first portion of tie yarns extend between a periphery of the first set of apertures and a periphery of the second set of apertures, the second portion of tie yarns extend between the first panel and the second panel outside of the periphery of respective apertures, the first portion of tie yarns are oriented at a more acute angle with respect to the first panel and the second panel compared to the second portion of tie yarns.

* * * * *